US008861992B2

(12) United States Patent
Suzuki

(10) Patent No.: US 8,861,992 B2
(45) Date of Patent: Oct. 14, 2014

(54) IMAGE FORMING DEVICE WITH CARTRIDGE REPLACEMENT ALERT SYSTEM

(75) Inventor: Satoru Suzuki, Kasugai (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 284 days.

(21) Appl. No.: 13/362,493

(22) Filed: Jan. 31, 2012

(65) Prior Publication Data

US 2012/0219307 A1 Aug. 30, 2012

(30) Foreign Application Priority Data

Feb. 28, 2011 (JP) ..... 2011-041805
Feb. 28, 2011 (JP) ..... 2011-041808
Feb. 28, 2011 (JP) ..... 2011-041816

(51) Int. Cl.
*G03G 15/08* (2006.01)
*G03G 15/00* (2006.01)

(52) U.S. Cl.
CPC ..... *G03G 15/556* (2013.01); *G03G 15/0889* (2013.01); *G03G 15/0827* (2013.01); *G03G 2215/0894* (2013.01)
USPC ..... 399/27; 399/64; 399/254

(58) Field of Classification Search
USPC ..... 399/27, 64, 119, 262, 263, 61, 254
See application file for complete search history.

(56) References Cited

U.S. PATENT DOCUMENTS 6,337,956 B1 1/2002 Sato et al.
2008/0131150 A1 6/2008 Tomita et al.
2009/0010659 A1 1/2009 Watanabe
2010/0202798 A1* 8/2010 Suzuki et al. ..... 399/118
2011/0222872 A1 9/2011 Minamikawa et al.
2012/0219307 A1 8/2012 Suzuki

FOREIGN PATENT DOCUMENTS

JP H03-198072 A 8/1991
JP H10-301386 A 11/1998
JP 2000-131936 A 5/2000
JP 2000-315009 A 11/2000
JP 2001-005276 A 1/2001

(Continued)

OTHER PUBLICATIONS

Japan Patent Office, Office Action for Japanese Patent Application No. 2011-041808 (counterpart Japanese patent application), mailed Feb. 12, 2013.

(Continued)

*Primary Examiner* — Hoang Ngo
(74) *Attorney, Agent, or Firm* — Merchant & Gould PC

(57) ABSTRACT

An image forming device includes a replaceable cartridge, a light-emitting element, a light-receiving element, and a determining unit. The replaceable cartridge accommodates developer therein and includes an agitator and a developing roller rotatable together with the agitator. The light-emitting element is configured to emit a light toward the replaceable cartridge. The light-receiving element is configured to receive the light emitted by the light-emitting element through the replaceable cartridge to output a signal. The determination value is produced based on the signal. The determining unit is configured to determine whether or not the determination value is greater than a predetermined determination threshold upon the agitator having rotated continuously more than a first prescribed number of times. The determining unit determines that the replaceable cartridge should be replaced with a new one when the determination value is greater than the predetermined determination threshold.

22 Claims, 12 Drawing Sheets

(56) References Cited

FOREIGN PATENT DOCUMENTS

| | | | |
|---|---|---|---|
| JP | 2004-361752 | A | 12/2004 |
| JP | 2005-181597 | A | 7/2005 |
| JP | 2008-139436 | A | 6/2008 |
| JP | 2009-037225 | A | 2/2009 |
| JP | 2010-186070 | A | 8/2010 |
| JP | 2010-186072 | A | 8/2010 |
| JP | 2010-281896 | A | 12/2010 |
| JP | 2011-215566 | A | 10/2011 |
| JP | 2012-177860 | A | 9/2012 |

OTHER PUBLICATIONS

Japan Patent Office, Office Action for Japanese Patent Application No. 2011-041816 (counterpart Japanese . patent application), mailed Mar. 19, 2013.

* cited by examiner

| TIMES OF ROTATION | FIRST ROTATION | SECOND ROTATION | THIRD ROTATION | FOURTH ROTATION | ... |
|---|---|---|---|---|---|
| DETERMINATION THRESHOLD | 50% | 20% | 10% | 10% | ... |

IMAGE FORMING DEVICE WITH CARTRIDGE REPLACEMENT ALERT SYSTEM

CROSS REFERENCE TO RELATED APPLICATION

This application claims priority from Japanese Patent Application Nos. 2011-041805 filed Feb. 28, 2011, 2011-041808 filed Feb. 28, 2011, and 2011-041816 filed Feb. 28, 2011. The entire content of each of these priority applications is incorporated herein by reference.

TECHNICAL FIELD

The present invention relates to an image forming device configured to detect optically the quantity of developer present in a replaceable cartridge.

BACKGROUND

In conventional technology, there are image-forming devices configured to detect the quantity of developer remaining in a replaceable cartridge optically. One such device provides a pair of light-transmissive windows in opposing side walls of the cartridge. The device irradiates light into one of the light-transmissive windows and detects light exiting from the other, then determines the quantity of developer remaining in the cartridge based on a signal acquired as a result of this detection. Thus, the image-forming device can make such determinations as when the cartridge needs to be replaced, for example, based on the quantity of developer detected in the cartridge.

SUMMARY

However, it is well known that the charging performance of developer gradually declines as the developer in the cartridge is repeatedly rubbed between the developing roller, thickness-regulating blade, and the like and as the developer is repeatedly agitated by an agitating member. For this reason, some consideration has been given for reducing the number of rotations of the developing roller and agitating member of an image-forming device during operations. However, it was found that such alterations could lead to inaccurate determinations of the replacement timing for the cartridge, particularly when printing a small number of sheets in single image-forming operations.

The reason for this is as follows: the agitating member scatters developer throughout the cartridge by rotating in the cartridge. However, developer that has accumulated in the bottom of the cartridge cannot be sufficiently scattered during the initial stage of rotation, particularly as the quantity of developer in the cartridge decreases. Consequently, when the agitating member first begins rotating, the irradiated light easily passes through the cartridge, enabling the light-receiving element to receive a large quantity (high intensity) of light. Thus, when the image-forming device makes a determination regarding whether the cartridge needs to be replaced while the agitating member is still in its initial stage of rotation (e.g., when only a few sheets are being printed in a single image-forming operation), the image-forming device may determine inaccurately that the cartridge needs to be replaced when in fact there is sufficient developer remaining.

In view of the foregoing, it is an object of the present invention to provide an image-forming device capable of suppressing a decline in developer charging capacity while being capable of accurately determining when a cartridge needs to be replaced.

In order to attain the above and other objects, the invention provides an image forming device including a replaceable cartridge, a light-emitting element, a light-receiving element, and a determining unit. The replaceable cartridge accommodates developer therein and includes an agitator and a developing roller. The agitator is rotatable and configured to agitate developer accommodated in the replaceable cartridge. The developing roller is configured to carry the developer thereon and rotatable together with the agitator. The light-emitting element is configured to emit a light toward the replaceable cartridge. The light-receiving element is configured to receive the light emitted by the light-emitting element through the replaceable cartridge to output a signal. The determination value is produced based on the signal. The determining unit is configured to determine whether or not the determination value is greater than a predetermined determination threshold upon the agitator having rotated continuously more than a first prescribed number of times. The determining unit determines that the replaceable cartridge should be replaced with a new one when the determination value is greater than the predetermined determination threshold.

According to another aspect, the present invention provides an image forming device including a replaceable cartridge, a light-emitting element, a light-receiving element, and a determining unit. The replaceable cartridge accommodates developer therein and includes an agitator and a developing roller. The agitator is rotatable and configured to agitate developer accommodated in the replaceable cartridge. The developing roller is configured to carry the developer thereon and rotatable together with the agitator. The light-emitting element is configured to emit a light toward the replaceable cartridge. The light-receiving element is configured to receive the light emitted by the light-emitting element through the replaceable cartridge to output a signal. The determination value is produced based on the signal each time when the agitator rotates one time. The determining unit is configured to determine whether or not the determination value is greater than a first predetermined threshold when the agitator has made first one rotation and determine that the replaceable cartridge should be replaced with a new one when the determination value is greater than the first predetermined threshold. The determining unit is further configured to determine whether or not the determination value is greater than a second predetermined threshold when the agitator has rotated a prescribed number of times and determine that the replaceable cartridge should be replaced with a new one when the determination value is greater than the second predetermined threshold.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, a general structure of a laser printer 1 according to a first embodiment of the present invention will be described. Then, a detailed description will be given on the structure and operations of the laser printer 1 relating to features of the present invention. Directions given in the following description will be based on the reference of a user operating the laser printer 1. Specifically, the right side of the laser printer 1 in FIG. 1 will be considered the "front," the left side the "rear," the near side the "left side," and the far side the "right side." Further, the "top" and "bottom" of the laser printer 1 in the following description will be based on the vertical directions in FIG. 1.

Figure 1:
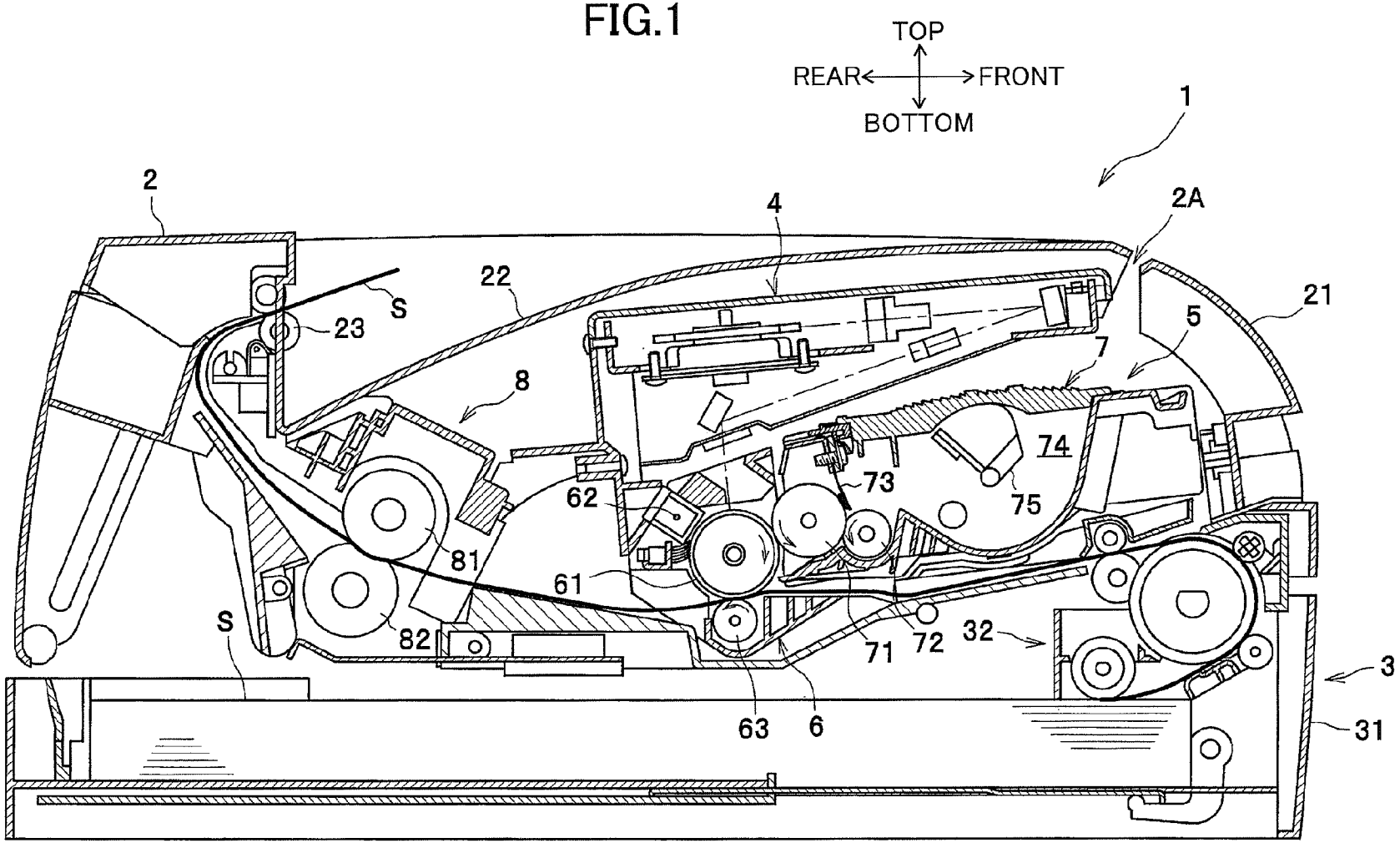
FIG. 1 is a schematic side view of an image forming device according to a first embodiment of the invention.

As shown in FIG. 1, the laser printer 1 includes a main casing 2 and, within the main casing 2, a feeding unit 3 for supplying sheets S of paper to be printed, an exposure unit 4, a process cartridge 5 for transferring toner images onto the sheets S, and a fixing unit 8 for fixing the toner images on the sheets S with heat.

The feeding unit 3 is provided in the bottom of the main casing 2 and primarily includes a paper tray 31 accommodating the sheets S, and a paper-feeding mechanism 32 for feeding sheets S from the paper tray 31 to be printed. The paper-feeding mechanism 32 supplies the sheets S from the paper tray 31 toward the process cartridge 5 (between a photosensitive drum 61 and a transfer roller 63) while separating the sheets S so that only one sheet is fed at a time.

The exposure unit 4 is disposed in the top section of the main casing 2 and includes a laser light-emitting unit (not shown), as well as a polygon mirror, lenses, reflecting mirrors, and other components for which reference numerals have not been assigned. The laser light-emitting unit in the exposure unit 4 emits a laser beam (indicated by a chain line in FIG. 1) based on image data, scanning the laser beam over the surface of the photosensitive drum 61 at a high speed to expose the same.

The process cartridge 5 is disposed below the exposure unit 4. A cover 21 provided on the front side of the main casing 2 can be opened to reveal an opening 2A through which the process cartridge 5 can be mounted in or removed from the main casing 2 (i.e., the process cartridge 5 is replaceable). The process cartridge 5 is configured of a drum unit 6, and a developing cartridge 7.

The developing cartridge 7 is detachably mounted on the drum unit 6. While mounted on the drum unit 6, the developing cartridge 7 can be detachably mounted in the main casing 2. The developing cartridge 7 primarily includes a developing roller 71, a supply roller 72, a thickness-regulating blade 73, a toner-accommodating section 74 for accommodating toner, and an agitator 75.

In the developing cartridge 7 having this construction, first the agitator 75 agitates toner inside the toner-accommodating section 74 while conveying (supplying) toner toward the supply roller 72. With both the developing roller 71 and supply roller 72 rotating, the supply roller 72 continues to supply the toner to the developing roller 71. As the developing roller 71 continues to rotate, toner supplied to the surface thereof passes under the thickness-regulating blade 73, and the thickness-regulating blade 73 regulates the toner carried on the developing roller 71 to a uniform thin layer.

The drum unit 6 primarily includes the photosensitive drum 61, a charger 62, and the transfer roller 63. With this drum unit 6, the charger 62 applies a uniform charge to the surface of the photosensitive drum 61, and the charged surface is subsequently exposed by a laser beam emitted from the exposure unit 4, forming an electrostatic latent image on the surface of the photosensitive drum 61.

Next, toner carried on the surface of the developing roller 71 is supplied to the electrostatic latent image formed on the surface of the photosensitive drum 61 to produce a toner image thereon. The toner image formed on the surface of the photosensitive drum 61 is subsequently transferred to a sheet S as the sheet S is conveyed between the photosensitive drum 61 and transfer roller 63.

The fixing unit 8 is disposed on the rear side of the process cartridge 5. The fixing unit 8 primarily includes a heating roller 81, and a pressure roller 82 disposed in confrontation with the heating roller 81 and applying pressure to the same. The fixing unit 8 having this construction fixes a toner image transferred onto the sheet S with heat as the sheet S passes between the heating roller 81 and pressure roller 82. After the toner image is fixed to the sheet S, discharge rollers 23 discharge the sheet S into a discharge tray 22.

Next, a detailed structure of the laser printer 1 and the operations (control process) performed on the laser printer 1 as they relate to features of the present invention will be described. First, the developing cartridge 7 and the structure on the main casing 2 side related to the present invention will be described, followed by a description of a control process performed in the laser printer 1.

Figure 2A:
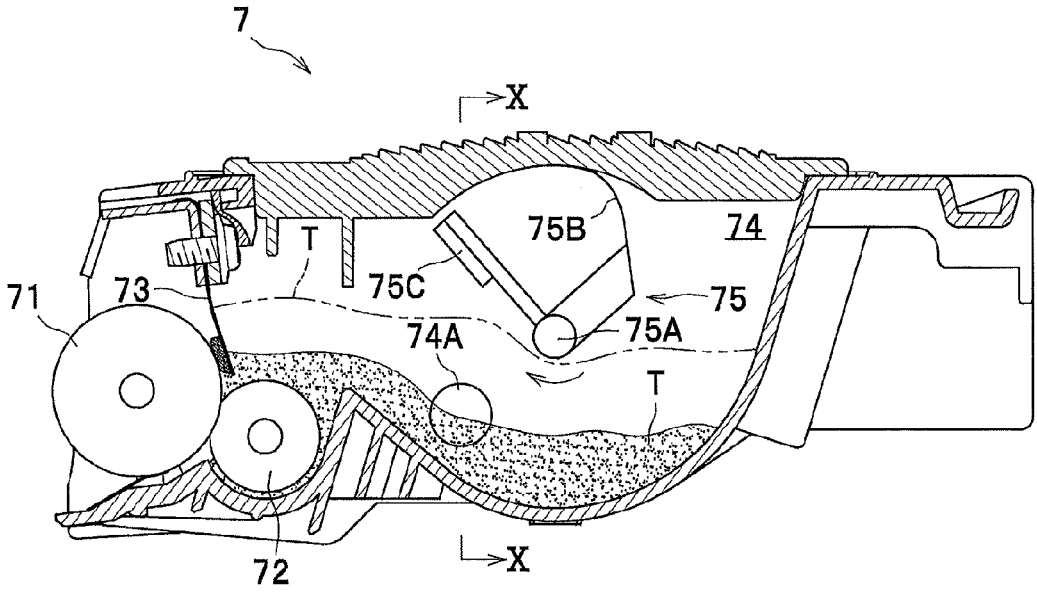
FIG. 2A is a cross-sectional view of a developer cartridge mounted in the image forming device.
Figure 2B:
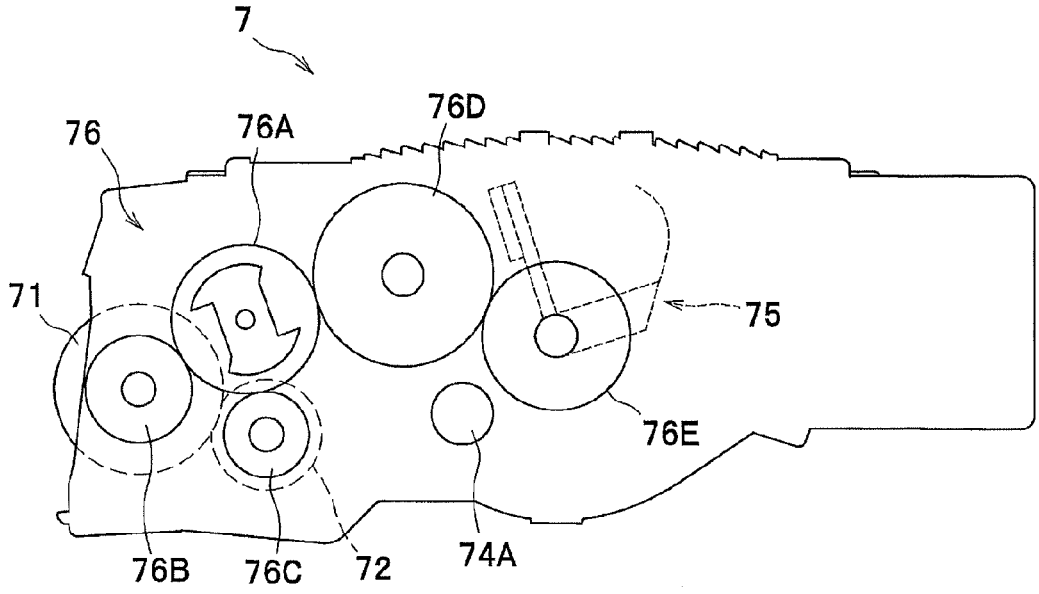
FIG. 2B is and a side view of the developer cartridge shown in FIG. 2A.

As shown in FIGS. 2A and 2B, the developing cartridge 7 includes a gear mechanism 76 in addition to the developing roller 71, toner-accommodating section 74, and agitator 75. A pair of opposing transparent light-transmissive parts 74A (see also FIG. 3) is provided one in each of left and right side walls (not assigned reference numerals) of the toner-accommodating section 74 so as to confront each other in the left-to-right direction.

The agitator 75 primarily includes a rotational shaft 75A rotatably supported in the left and right side walls of the toner-accommodating section 74, a flexible sheet member 75B for agitating and conveying a toner T in the toner-accommodating section 74 when the agitator 75 rotates, and wipers 75C for wiping off toner T that has become deposited on the light-transmissive parts 74A while the agitator 75 rotates.

The gear mechanism 76 is disposed on the left side surface of the developing cartridge 7 and functions to transmit a drive force inputted from the laser printer 1 to the developing roller 71, supply roller 72, and agitator 75. The gear mechanism 76 primarily includes an input gear 76A in which the drive force is inputted; a developing roller gear 76B and a supply roller gear 76C that are both engaged with the input gear 76A; and an agitator gear 76E that is engaged with the input gear 76A via an intermediate gear 76D.

The developing roller gear 76B, supply roller gear 76C, and agitator gear 76E are integrally provided on an end of the rotational shaft for the respective developing roller 71, supply roller 72, and agitator 75 and respectively drive the developing roller 71, supply roller 72, and agitator 75 to rotate. Thus, the gear mechanism 76 having this construction can rotate both the developing roller 71 and agitator 75 in the developing cartridge 7 from a drive force inputted into the input gear 76A.

Figure 3:
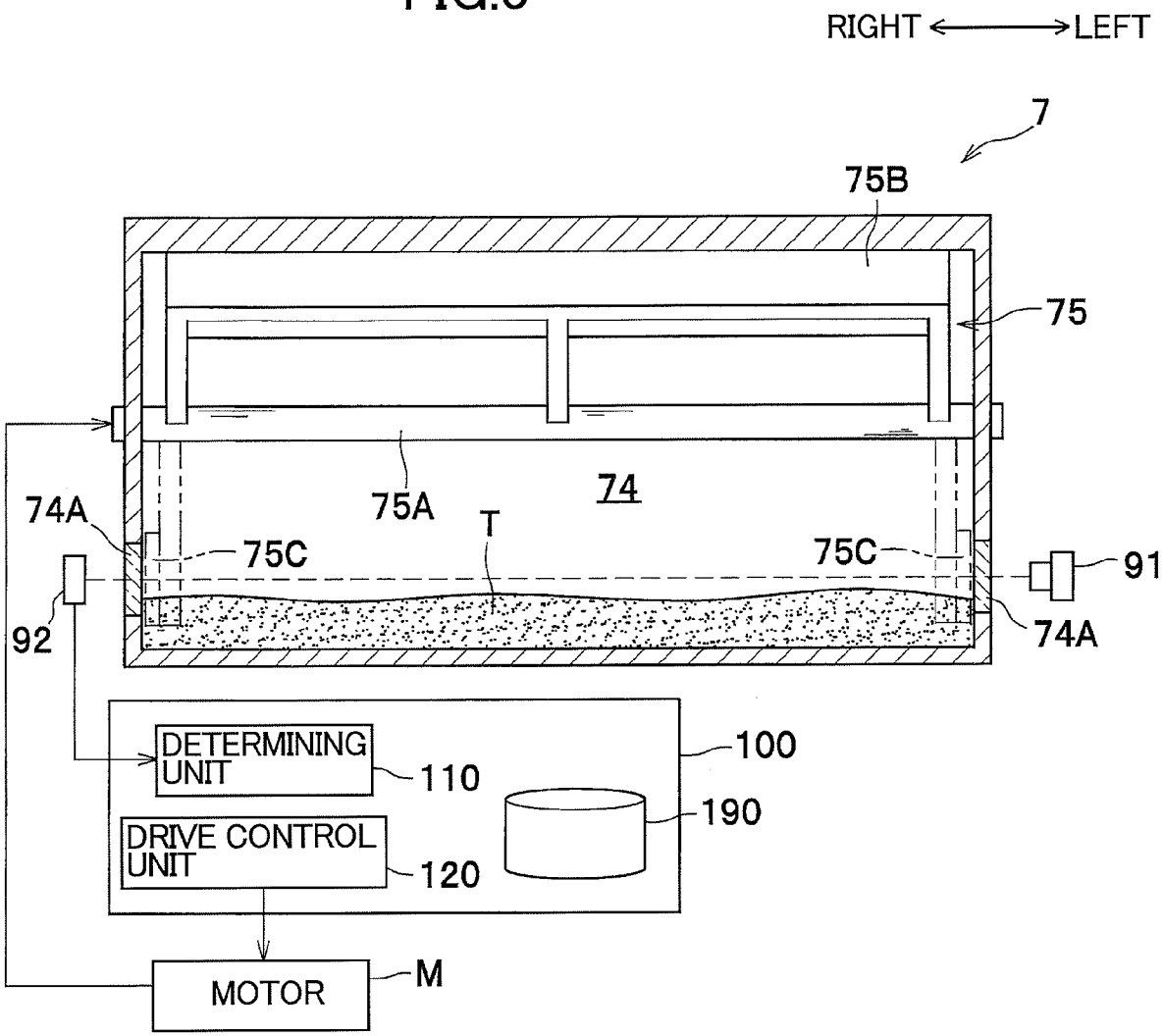
FIG. 3 is an explanatory diagram including a cross-sectional view of the developer cartridge taken along a line X-X in FIG. 2A and a control unit, a light-emitting element, a light-receiving element, and a motor of the image forming device.

As shown in FIG. 3, the laser printer 1 also includes the following components all accommodated in the main casing 2: a motor M serving as a drive source, a light-emitting element 91, a light-receiving element 92, and a control unit 100 that controls operations of the laser printer 1.

A drive force produced by the motor M is inputted into the gear mechanism 76 of the developing cartridge 7 via a drive transmission mechanism (not shown) well known in the art and is transferred to the developing roller 71 and the agitator 75.

The light-emitting element 91 and light-receiving element 92 are arranged facing each other on opposing sides of the pair of light-transmissive parts 74A provided in the developing cartridge 7 when the developing cartridge 7 is mounted in the main casing 2. A common photosensor known in the art may be employed as the light-emitting element 91 and light-receiving element 92, for example. Light emitted from the light-emitting element 91 (indicated by a dashed line) enters the developing cartridge 7 (toner-accommodating section 74) through one light-transmissive parts 74A, passes through the toner-accommodating section 74, and exits the other light-transmissive parts 74A, where the light is received by the light-receiving element 92.

The light-receiving element 92 outputs a light reception signal to the control unit 100 (a determining unit 110 described later) in response to received light, as shown in the graph of FIG. 4. The light reception signal is an output voltage that varies based on the amount of received light (the intensity of received light). The light-receiving element 92 employed in the first embodiment outputs a smaller output voltage for weaker intensities of received light and a larger output voltage for stronger intensities of received light.

When a large amount of toner T is present in the developing cartridge 7, light entering the developing cartridge 7 is shielded by the toner T, as indicated by the double chain line in FIG. 2A. In this case, the light-receiving element 92 receives very little light. Hence, a light reception signal, such as that shown in FIGS. 4A and 4B, is not received until the quantity of toner T in the developing cartridge 7 has dropped to some extent.

The control unit 100 is configured of a CPU, a RAM, a ROM, an input/output interface, and other components not shown in the drawings and functions to control the components of the laser printer 1 based on preconfigured programs and the like. As shown in FIG. 3, the control unit 100 primarily includes, as functional units related to the invention, a determining unit 110, a drive control unit 120, and a storage unit 190.

The determining unit 110 is configured to determine the replacement timing based on the light reception signal continuously outputted from the light-receiving element 92. In the first embodiment, the determining unit 110 executes the replacement timing determination only after the agitator 75 has rotated continuously more than a prescribed number of times (two times in the first embodiment). Hence, the determining unit 110 of the first embodiment executes the determination during the third or a later rotation after the agitator 75 begins rotating.

Figure 4A:
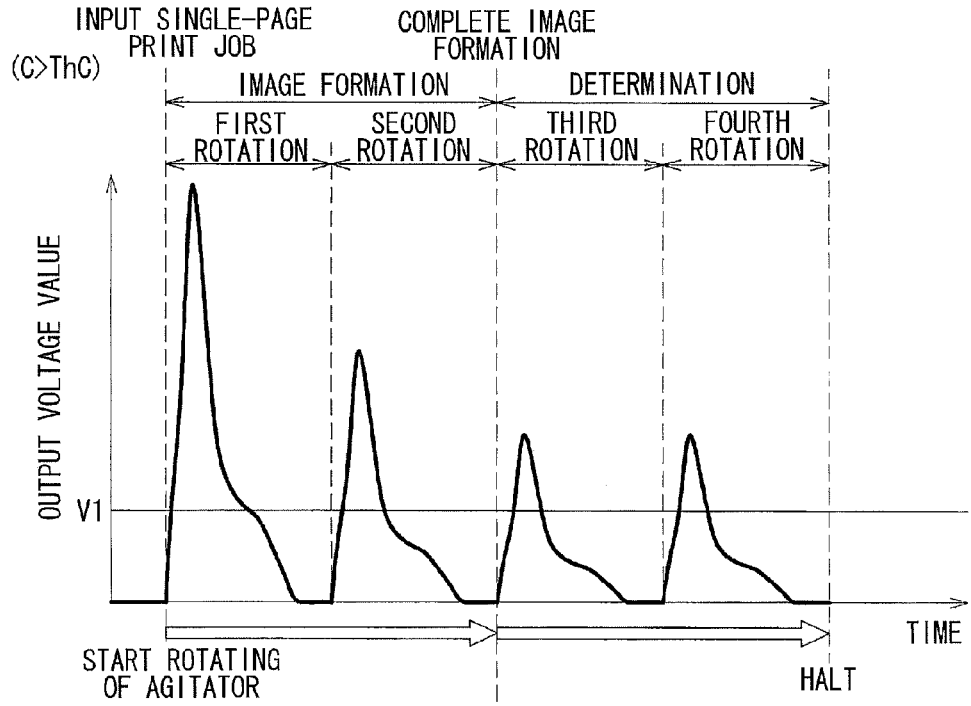
FIG. 4A is a graph indicating a relationship between time and output voltage value of the light-receiving element when an index value exceeds a prescribed index threshold.
Figure 4B:
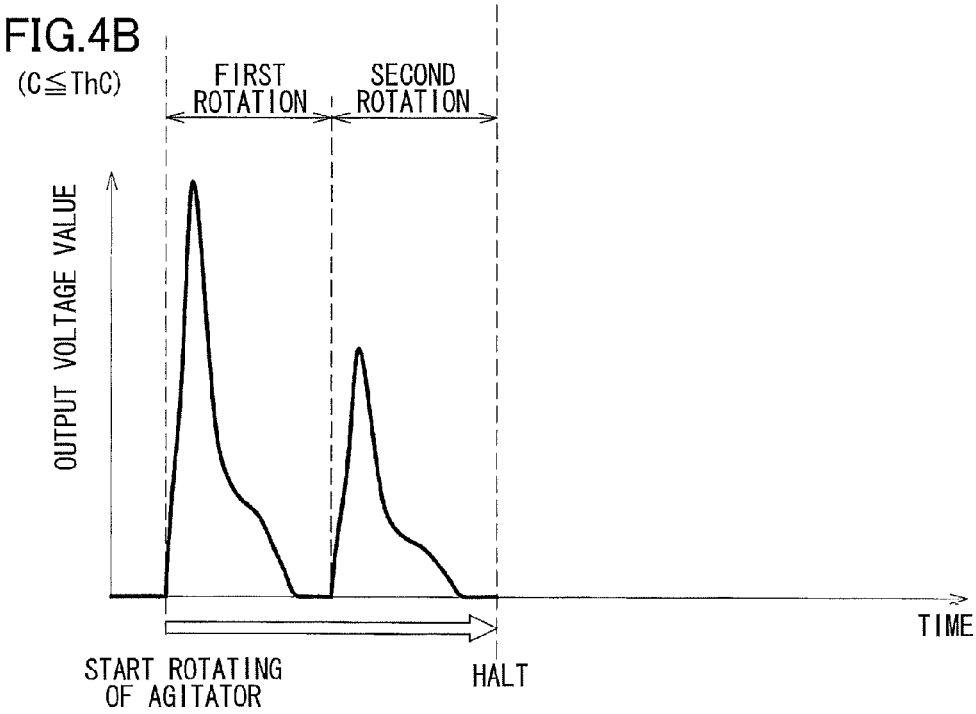
FIG. 4B is a graph indicating a relationship between time and output voltage value of the light-receiving element when an index value does not exceed the prescribed index threshold.

Here, the agitator 75 rotating continuously more than the prescribed number of times (two rotations in this example) indicates that an operation has been executed to rotate the agitator 75 continuously more than two rotations, and more specifically when the laser printer 1 receives an inputted print job having a large number of pages to be printed in a single image-forming operation (a print job for forming an image on two or more sheets S in one image-forming operation, in this example; hereinafter referred to as a "continuous print job") and the laser printer 1 executes an image-forming operation based on this continuous print job; when the laser printer 1 executes an operation to continuously rotate the agitator 75 after a count C exceeds a prescribed threshold ThC, as will be described later (see FIG. 4A).

The method implemented by the determining unit 110 for determining whether the developing cartridge 7 needs to be replaced will be described while referring to FIG. 4A. First, the determining unit 110 calculates the time during which the output voltage value from the light-receiving element 92 based on the amount of received light exceeds a preset light reception reference value V1 during a third or later rotation of the agitator 75 after the agitator 75 begins rotating (the fourth rotation in the first embodiment). Next, the determining unit 110 calculates the ratio of the time during which this output value exceeds the light reception reference value V1 to one period constituting the fourth rotation (hereinafter referred to as the "determination value R"). In other words, the determining unit 100 determines whether or not the determination value is greater than a predetermined determination threshold upon the agitator having rotated continuously more than a predetermined number of times (three in this embodiment). The predetermined number of rotations is no less than the prescribed number of rotations (two rotations in the first embodiment) sufficient to perform an image formation for a single-page print job described later.

The determination is executed in the third or later rotation (when the agitator 75 has rotated more than the prescribed number of times) for the following reason. The agitator 75 scatters toner T throughout the developing cartridge 7 by rotating therein. However, toner that has accumulated in the bottom of the developing cartridge 7 cannot be sufficiently scattered during the initial rotation of the agitator 75 (the first and second rotations in FIG. 4A), particularly as the quantity of toner T decreases, as indicated by the solid line in FIG. 2A. Consequently, when the agitator 75 first begins rotating, the irradiated light easily passes through the developing cartridge 7, and the light-receiving element 92 outputs a large voltage.

However, since the toner T in the developing cartridge 7 generally is uniformly scattered in the developing cartridge 7 of the first embodiment by the third and later rotations of the agitator 75 after the agitator 75 begins rotating, output voltages (the light reception signal) from the light-receiving element 92 become a stable waveform. Hence, "two rotations" in the first embodiment corresponds to the number of times the agitator 75 must rotate before the output voltage from the light-receiving element 92 stabilizes.

Based on this information, when the determination is executed during the first or second rotations of the agitator 75, there is a chance that the accuracy of the determination regarding whether the developing cartridge 7 needs replacing will be low (e.g., the determination unit 110 may determine that the developing cartridge 7 needs replacing when there is still sufficient toner T remaining). Therefore, the determination unit 110 in the first embodiment executes the determination for determining whether the developing cartridge 7 needs replacing during the third or a subsequent rotation of the agitator 75 while the output voltage from the light-receiving element 92 is stable.

Next, the laser printer 1 determines whether or not the determination value R exceeds a prescribed ratio (a determination threshold ThR) (R>ThR) and judges that the developing cartridge 7 needs to be replaced when the determination value R exceeds the determination threshold ThR. If the determination threshold ThR is set to 10% and the determination value R is 11%, for example, then the determination value R exceeds the determination threshold ThR and the laser printer 1 determines that it is time to replace the developing cartridge 7 currently mounted in the laser printer 1.

After determining that the developing cartridge 7 needs to be replaced, the determining unit 110 notifies the user that it is time to replace the developing cartridge 7 by displaying a message on a display provided on the laser printer 1, by playing a warning sound, and the like.

Here, the determining unit 110 does not make a determination on the replacement timing of the developing cartridge 7 if the agitator 75 is rotated only two times or less (the first or second rotations in FIG. 4) since a determination made during the first couple of rotations might be less accurate. Hence, when an operation to rotate the agitator 75 two or fewer times is repeatedly executed if the determining unit 110 does not possess the function described later, then there potentially arises a situation in which the replacement timing of the developing cartridge 7 is determined for an extended period of time.

In the first embodiment, the determining unit 110 counts an index value indicating the quantity of toner T used during consecutive operations for rotating the agitator 75 two or fewer times. When this count (index value) C exceeds a predetermined threshold ThC, i.e., when it is estimated that a fixed amount of toner T in the developing cartridge 7 has been used, the determining unit 110 is configured to determine that the developing cartridge 7 needs to be replaced.

More specifically, the determining unit 110 first counts the number of single-page print jobs, as an example of the index value, while consecutively receiving print jobs for which the agitator 75 need only be rotated twice to complete the image-forming operation (hereinafter referred to as "single-page print jobs"). Here, a "single-page print job" is defined as a print job for which the agitator 75 rotates two times during the image-forming operation since the number of pages being printed during one image forming operation is few (one page in this example). Here, the "single-page print job" denotes a print job for which the agitating member is rotated no more than the prescribed number of times because there are few pages to be printed in one image-forming operation. The "prescribed number of rotations" denotes the number of rotations of the agitating member and serves as a borderline between different determination results for cases in which the number of rotations of the agitating member does and does not exceed the prescribed number of rotations when determining whether a determination value exceeds a determination threshold based on the quantity of light received by the light-receiving element.

Hence, when the number of inputted single-page print jobs (the count C) exceeds the threshold ThC (10, for example), then the determining unit 110 rotates the agitator 75 more than two times continuously and determines the replacement timing of the developing cartridge 7. That is, when the count C exceeds the threshold ThC (C>ThC), as shown in FIG. 4A, the determining unit 110 controls the drive control unit 120 to continuously rotate the agitator 75 two more times without stopping after completing an image-forming operation based on the last inputted single-page print job (after the agitator 75 has been rotated twice), calculates the determination value R in the fourth rotation from the beginning of rotation, and determines whether the calculated determination value R is greater than the determination threshold ThR (R>ThR?).

Further, the determining unit 110 resets the count C when the agitator 75 has rotated continuously more than two times, and more specifically at one of the following timings: prior to rotating the agitator 75 more than two times (when establishing that the agitator 75 will be rotated more than two times), while the agitator 75 is rotated more than two times, or after the agitator 75 has been rotated more than two times.

More specifically, the determining unit 110 resets the count C at any one of the following timings: when a continuous print job is inputted while counting the number of times single-page print jobs are inputted consecutively; during or after executing an image-forming operation based on a continuous print job; during or after rotating the agitator 75 more than two times continuously due to the count C exceeding the threshold ThC; and the like. The replacement timing for the developing cartridge 7 is determined in such cases in order to avoid such situations in which the replacement timing is not determined for an extended period of time.

Note that when the count C does not exceed the threshold ThC, as in the example of FIG. 4B, the determining unit 110 halts rotation of the agitator 75 via the drive control unit 120 by completing the image-forming operation based on the current single-page print job. In this case, the agitator 75 is halted after two rotations from the beginning of rotation.

The drive control unit 120 has a function for controlling the drive of the agitator 75 (rotate/stop) and the number of rotations via the drive transmission mechanism (not shown) provided in the laser printer 1, and the gear mechanism 76, by controlling the drive of the motor M (switching the motor M on/off, controlling the speed of the motor M, and the like).

When rotating the agitator 75 four times, for example, the drive control unit 120 drives (turns on) the motor M for exactly the time required to rotate the agitator 75 four times. To halt the agitator 75, the drive control unit 120 halts (turns off) the motor M.

Figure 5:
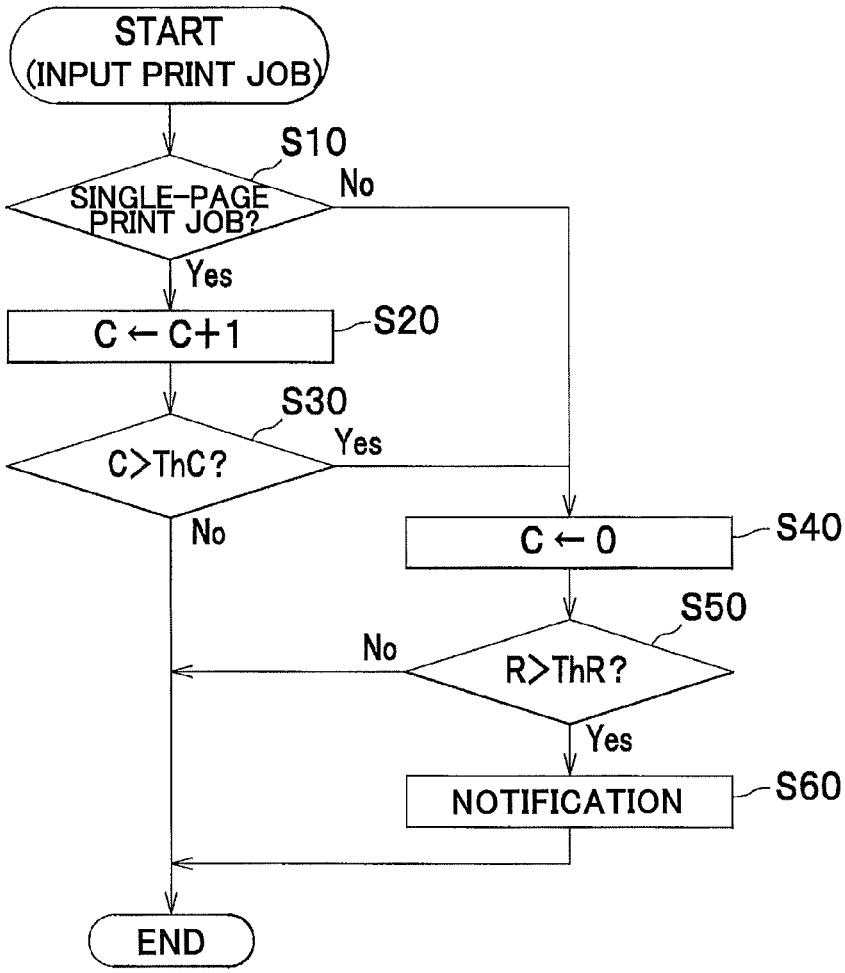
FIG. 5 is a flowchart illustrating steps of control process executed by the image forming device.

Next, steps in a control process performed in the laser printer 1 will be described with reference to the flowchart in FIG. 5. When a print job is inputted into the laser printer 1 (START), in S10 of FIG. 5 the control unit 100 executes an image-forming operation based on the inputted print job and determines whether the inputted print job is a single-page print job.

If the inputted print job is a single-page print job (S10: YES), in S20 the control unit 100 increments by "1" the count C, which indicates the number of consecutively inputted single-page print jobs, and in S30 determines whether the count C exceeds the threshold ThC.

If the count C does not exceed the threshold ThC (S30: NO), the control unit 100 ends the process at the completion of the image-forming operation (END). However, if the count C exceeds the threshold ThC (S30: YES), in S40 the control unit 100 resets the count C to "0" and in S50, after completion of the image-forming operation, continues to rotate the agitator 75 while calculating the determination value R, and determines whether the determination value R exceeds the determination threshold ThR, i.e., whether the developing cartridge 7 needs to be replaced.

On the other hand, if the control unit 100 determines in S10 that the inputted print job is not a single-page print job (S10: NO), then in S40 the control unit 100 resets the count C to "0" and in S50 determines whether the developing cartridge 7 needs to be replaced while executing an image-forming operation based on the continuous print job.

If there is sufficient toner T remaining in the developing cartridge 7 (i.e., if the developing cartridge 7 does not need to be replaced), in S50 the control unit 100 will determine that the determination value R does not exceed the determination threshold ThR (S50: NO). Accordingly, the control unit 100 ends the process (END). Note that the control unit 100 completes the image-forming operation before ending the process when executing an image-forming operation based on a continuous print job.

However, if very little toner T remains in the developing cartridge 7 (when it is time to replace the developing cartridge 7), in S50 the control unit 100 will determine that the determination value R exceeds the determination threshold ThR (S50: YES) and, hence, in S60 notifies the user that the developing cartridge 7 needs to be replaced. Subsequently, the control unit 100 ends the process (END).

With the configuration described above, the laser printer 1 according to the first embodiment obtains the following operational advantages. That is, the determining unit 110 counts the number of times single-page print jobs have been inputted while receiving such single-page print jobs in succession, and determines that the developing cartridge 7 needs to be replaced when the count C exceeds the threshold ThC. Hence, the laser printer 1 according to the first embodiment can reduce the total number of rotations of the agitator 75 than a printer that determines the replacement timing of a cartridge by rotating the agitator 75 more than two times following every completion of an image-forming operation based on a single-page print job.

By reducing the total rotations of the agitator 75, as well as the developing roller 71 that is configured to rotate together with the agitator 75, the laser printer 1 according to the preferred embodiment can suppress a decline in the charging performance of the toner T, thereby increasing the life of the developing cartridge 7. Since the preferred embodiment can also reduce the initial volume of the toner T accommodated in the developing cartridge 7 while maintaining a lifespan for the developing cartridge 7 generally equal to a conventional developer cartridge, the developing cartridge 7 and the laser printer 1 can be made more compact.

Further, the determining unit 110 determines the replacement timing of the developing cartridge 7 after the light reception signal from the light-receiving element 92 has stabilized, by first rotating the agitator 75 continuously more than the prescribed number of rotations in order that the toner T is sufficiently scattered within the developing cartridge 7. Accordingly, the replacement timing can be more accurately determined than when the determination is made in the initial rotation of the agitator 75 (in the first or second rotation in FIG. 4B).

In the first embodiment, the determining unit 110 also resets the count C when the agitator 75 has been continuously rotated more than two times, thereby preventing unnecessary repetitions of the replacement timing determination. Thus, the laser printer 1 according to the first embodiment further reduces the total number of times that the agitator 75 and developing roller 71 are rotated, thereby further suppressing a decline in charging capacity of the toner T.

While the first embodiment described above uses the number of times single-page print jobs are inputted consecutively as the index for the quantity of toner T being used, the present invention is not limited to this index. For example, the index may be the number of dots (pixels) of the image transferred onto the sheet S when means are provided for counting the number of dots. Alternatively, the index may be the number of sheets S that are printed when means are provided for counting the number of sheets S.

Next, a second embodiment of the present invention will be described, wherein like parts and components are designated with the same reference numerals to avoid duplicating description.

Figure 6:
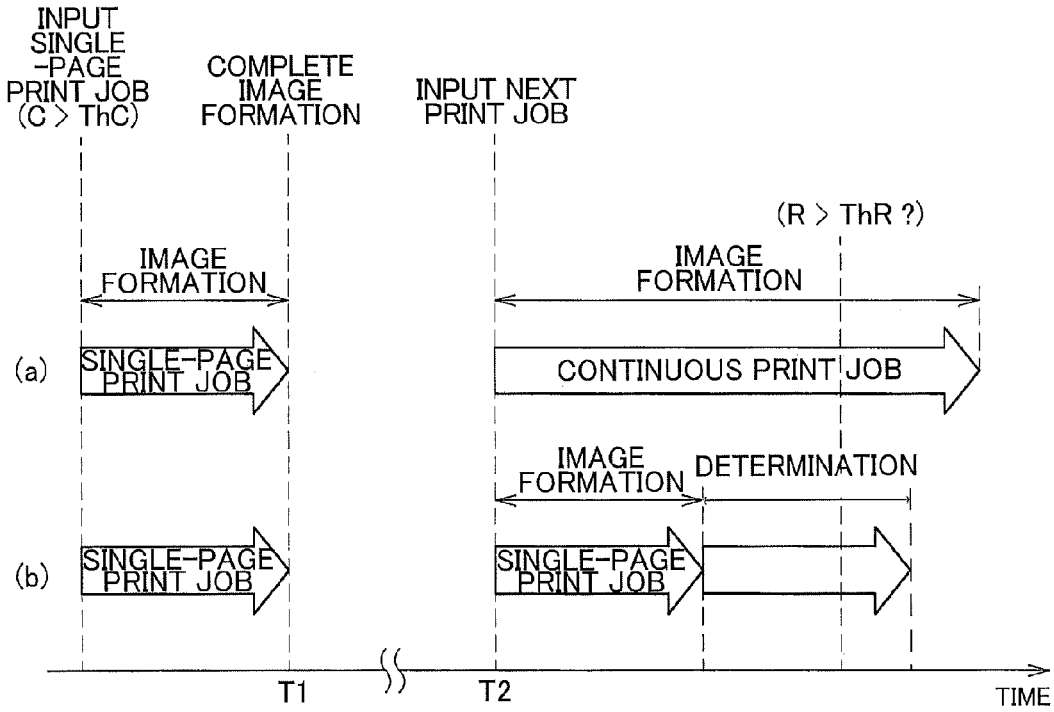
FIG. 6 is an explanatory diagram showing operations executed by an image forming device according to a second embodiment (a) when a continuous print job is received as a next print job and (b) when a single-page print job is received as the next print job.

In FIG. 6 (and FIG. 7 of the third embodiment) referred to in the following description, the arrows depicted in outline (i.e., unfilled arrows) indicate that the agitator 75 is rotating. If the text "Single-page print job" or "Continuous print job" is included in an arrow, this indicates that the agitator 75 is rotating to perform an image-forming operation. Arrows having no text indicate that the agitator 75 is being rotated to determine the replacement timing of the cartridge.

In the first embodiment described above, when the determining unit 110 determines that the count C exceeds the threshold ThC, the control unit 100 first completes the image-forming operation based on the last inputted single-page print job, then continues rotating the agitator 75 without pause to determine the replacement timing for the developing cartridge 7. However, it may be difficult to implement a control process to continue rotating the agitator 75 seamlessly after an image-forming operation is completed due to improved speeds in image-forming operations and the like (i.e., there may be a delay before the control process can be implemented).

Therefore, when the determining unit 110 according to the second embodiment determines that the count C exceeds the threshold ThC, the determining unit 110 waits until the next print job has been inputted before rotating the agitator 75 continuously more than two times in order to determine the replacement timing for the developing cartridge 7.

More specifically, as indicated in (a) and (b) of FIG. 6, when the determining unit 110 determines that the count C exceeds the threshold ThC (C>ThC), the determining unit 110 temporarily halts rotations of the agitator 75 by completing the image-forming operation based on the current single-page print job (timing t1). When the next print job is inputted, the determining unit 110 determines the replacement timing for the developing cartridge 7 (R>ThR?).

Note that, if the next inputted job is a continuous print job as shown in (a) of FIG. 6, the agitator 75 will be continuously rotated more than two times anyway. Therefore, the determining unit 110 determines the replacement timing for the developing cartridge 7 during the image-forming operation as usual. When the next inputted job is a single-page print job as shown in (b) of FIG. 6, the determining unit 110 first completes the image-forming operation based on the single-page print job (timing t2), then without pausing continues rotating the agitator 75 for a total of four rotations while determining the replacement timing for the developing cartridge 7 (see FIG. 4A).

Next, a third embodiment of the present invention will be described. When the determining unit 110 according to the third embodiment determines that the count C has exceeded the threshold ThC, the determining unit 110 first completes the image-forming operation based on the current single-page print job, then executes an operation to determine the replacement timing for the developing cartridge 7 by continuously rotating the agitator 75 a prescribed number of times (four times in this example).

Figure 7:
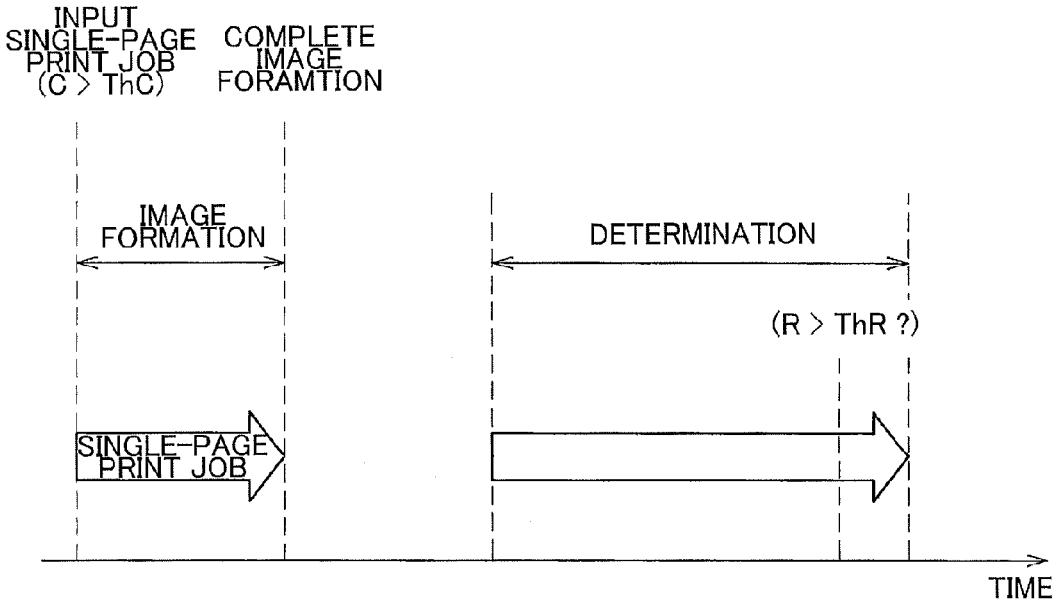
FIG. 7 is an explanatory diagram showing operations executed by an image forming device according to a third embodiment.

More specifically, as shown in FIG. 7, when the determining unit 110 determines that the count C exceeds the threshold ThC (C>ThC), the determining unit 110 temporarily halts the rotation of the agitator 75 by completing the image-forming operation based on the current single-page print job. Next, with the agitator 75 beginning from an idle state, the determining unit 110 rotates the agitator 75 continuously four times, for example, and executes an operation to determine the replacement timing for the developing cartridge 7 (R>ThR?) in the fourth rotation. In other words, if the index value count C exceeds the threshold ThC, the determining unit 110 and the drive control unit 120 controls the agitator to halt rotating when the image formation for a last print job is completed and further controls the agitator to begin to rotate when a predetermined duration of time is elapsed since the agitator halts rotating.

The present invention according to the second and third embodiments described above can be applied to a laser printer for accurately determining the replacement timing for the developing cartridge 7 while suppressing a decline in the charging performance of the toner, even in a laser printer performing faster image-forming operations, for example. Put a different way, employing the configurations of the second and third embodiments can improve the speed of image-forming operations.

Next, a fourth embodiment of the present invention will be described. In the first through third embodiments described above, the determining unit 110 determines the replacement timing for the developing cartridge 7 when a prescribed number of single-page print jobs has been inputted consecutively (when the count C reaches a value exceeding the threshold ThC). This process is similar to determining the replacement timing at specific intervals (albeit irregular intervals). In the fourth embodiment, the determining unit 110 is configured to determine the replacement timing for the developing cartridge 7 at regular intervals.

In other words, at prescribed intervals, the determining unit 110 according to the fourth embodiment rotates the agitator 75 continuously a prescribed number of times (four times, for example) while determining the replacement timing for the developing cartridge 7. The prescribed interval in the fourth embodiment is a longer duration than the duration required to rotate the agitator 75 two times.

Figure 8:
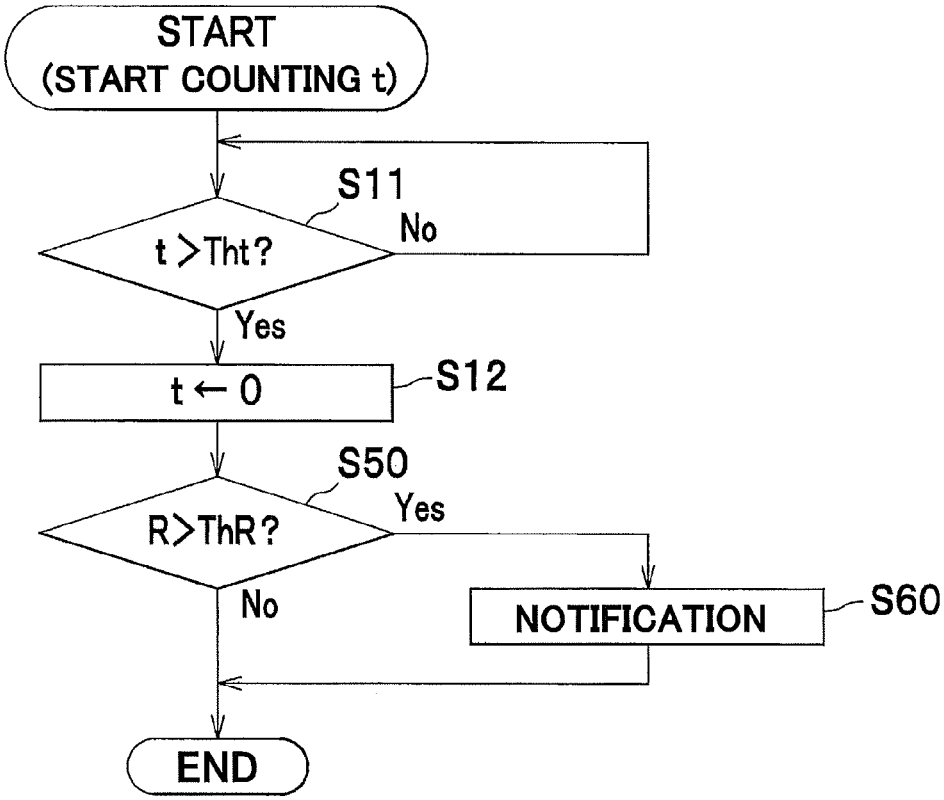
FIG. 8 is a flowchart illustrating steps of control process executed by an image forming device according to a fourth embodiment.

Specifically, the determining unit 110 begins counting a time t (START) in the process shown in the flowchart of FIG. 8 at one of the following timings: (1) when the power to the laser printer 1 is turned on, (2) when the cover 21 is closed, (3) when an image-forming operation based on the last print job is completed, (4) when the last determination for the replacement timing was made, or the like. In S11 the determining unit 110 determines whether a prescribed time Tht (six hours, for example) greater than the time required to rotate the agitator 75 two times has elapsed (t>Tht?).

If the prescribed time Tht has elapsed (S11: YES), in S12 the determining unit 110 resets the time t and in S50 the determining unit 110 rotates the agitator 75 from its halted state four times continuously and determines the replacement timing for the developing cartridge 7 (R>ThR?).

If the determining unit 110 determines that it is not time to replace the developing cartridge 7 (S50: NO), the determining unit 110 ends the current process (END) and resumes counting the time t (returns to START). However, if the determining unit 110 determines that it is time to replace the developing cartridge 7 (S50: YES), in S60 the determining unit 110 notifies the user that the developing cartridge 7 must be replaced and ends the current process (END).

According to the fourth embodiment described above, the determining unit 110 determines the replacement timing for the developing cartridge 7 at intervals of the prescribed time Tht greater than the time required to rotate the agitator 75 two times. Accordingly, the total rotations of the agitator 75 and developing roller 71 is less than the total rotations when the determining unit 110 determines the replacement timing by rotating the agitator 75 more than two times after each completion of an image-forming operation based on a single-page print job, thereby suppressing a decline in the charging performance of the toner T. Further, by determining the replacement timing after first rotating the agitator 75 more than two times continuously, the determining unit 110 can accurately determine the replacement timing.

Next, a fifth embodiment of the present invention will be described. In the fifth embodiment, the determination unit 110 includes a function for determining the replacement timing for the developing cartridge 7 (main determination), and a function for determining whether to execute the main determination (provisional determination). When the determination unit 110 determines in the main determination that the developing cartridge 7 needs to be replaced, the determination unit 110 notifies the user to replace the developing cartridge 7 by displaying a message on a display provided on the laser printer 1, by playing a warning sound, and the like.

The main determination and provisional determination will be described. The main determination according to the fifth embodiment is executed in the third or later rotation after the agitator 75 begins rotating, when the agitator 75 has continuously rotated more than a prescribed number of times, and more specifically when the laser printer 1 receives the continuous print job and executes an image-forming operation based on this continuous print job; and when the laser printer 1 executes an operation to continuously rotate the agitator 75 after a determination value R exceeds a provisional prescribed threshold Th1, as will be described later (see FIG. 9B).

In the main determination, the determining unit 110 calculates the determination value R during the third or later rotation of the agitator 75 after the agitator 75 begins rotating (the fourth rotation in the fifth embodiment). Then, the determining unit 110 determines whether the determination value R exceeds a main prescribed ratio (a main determination threshold Th1) (R>Th1) and judges that the developing cartridge 7 needs to be replaced when the determination value R exceeds the main determination threshold Th1.

Further, the determination unit 110 executes the provisional determination before the agitator 75 has completed rotating the prescribed number of times upon receiving an inputted the single-page print job. Hence, when a single-page print job is inputted into the laser printer 1, the determination unit 110 in the fifth embodiment executes the provisional determination during this image-forming operation (i.e., while the agitator 75 is rotating only twice).

Figure 9A:
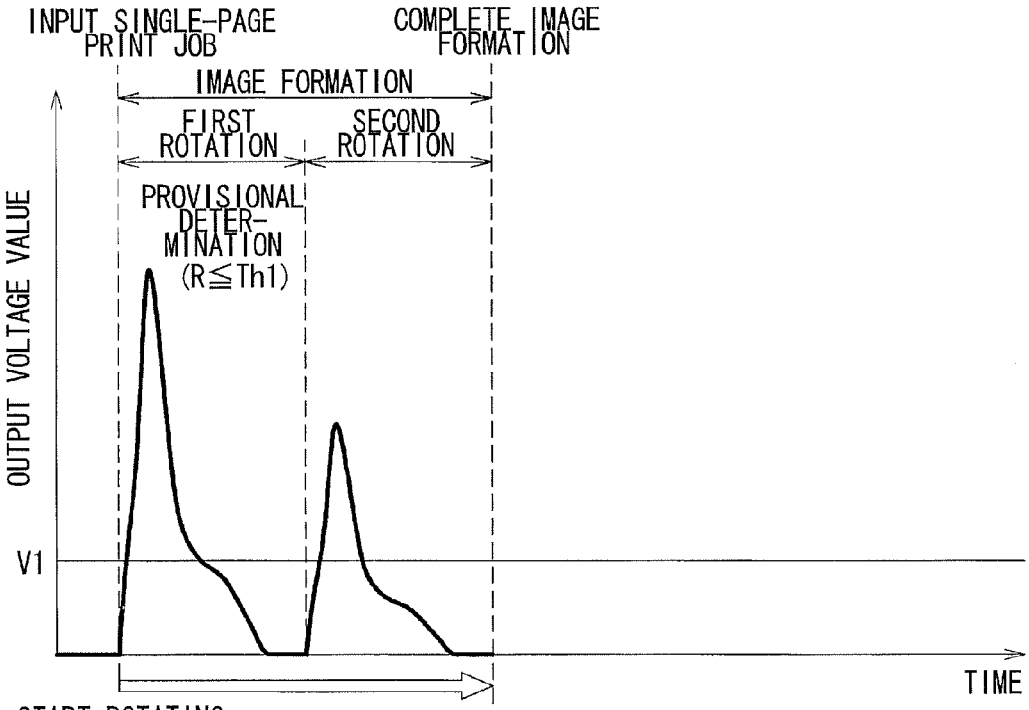
FIG. 9A is a graph indicating a relationship between time and output voltage value of the light-receiving element when a determination value does not exceed a provisional determination threshold in a fifth embodiment.
Figure 9B:
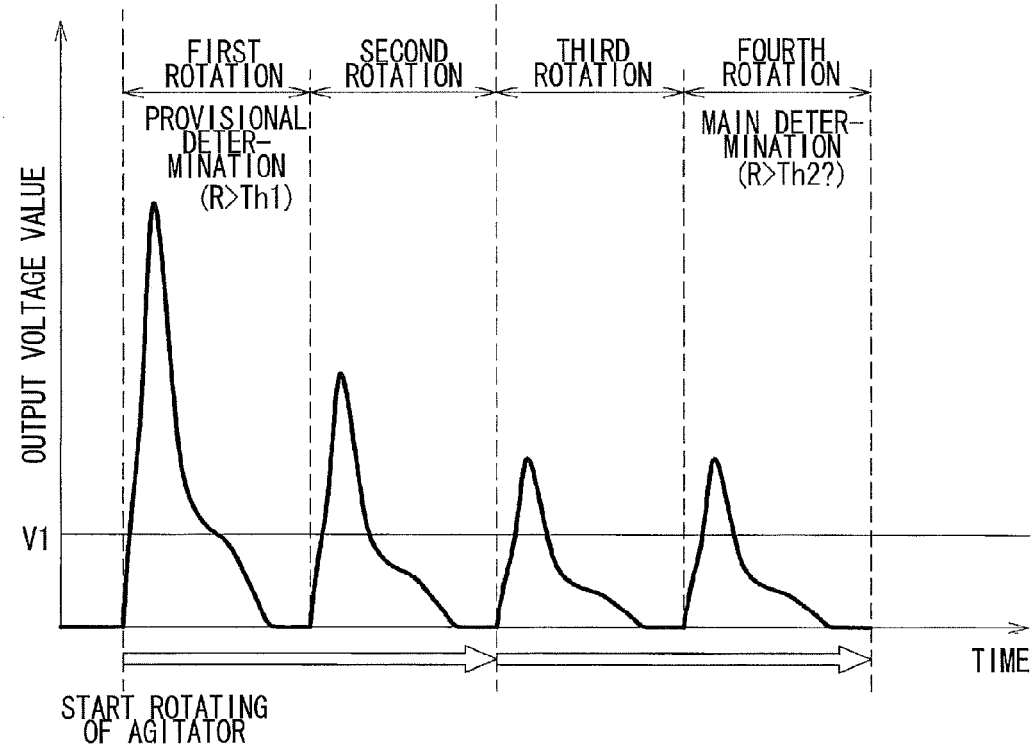
FIG. 9B is a graph indicating a relationship between time and output voltage value of the light-receiving element when the determination value exceeds the provisional determination threshold in the fifth embodiment.

The provisional determination is performed similarly to the main determination. As shown in FIGS. 9A and 9B, the determination unit 110 first calculates the determination value R during the first rotation (or second rotation) of the agitator 75. Next, the determination unit 110 determines whether the determination value R exceeds a prescribed ratio (a provisional determination threshold Th1) larger than the main determination threshold Th2 described above. If the provisional determination threshold Th1 is set to 20% and the determination value R is 19%, for example, then the determination unit 110 determines that the determination value R does not exceed the provisional determination threshold Th1. However, if the determination value R is 21%, the determination unit 110 determines that the determination value R exceeds the provisional determination threshold Th1.

When the determination value R does not exceed the provisional determination threshold Th1 (R≤Th1), as in the example of FIG. 9A, the determination unit 110 halts rotation of the agitator 75 via the drive control unit 120 by completing the image-forming operation based on the current single-page print job (an operation to form images on one sheet S). In this case, the agitator 75 is halted after two rotations from the beginning of rotation.

However, if the determination value R exceeds the provisional determination threshold Th1 (R>Th1), as in the example of FIG. 9B, the determination unit 110 stores a flag indicating this information (provisional determination flag) in the storage unit 190 (e.g., sets F to "1") and controls the drive control unit 120 to continuously rotate the agitator 75 more than two times while executing the main determination.

That is, when determining that the determination value R calculated in the first rotation of the agitator 75 exceeds the provisional determination threshold Th1, the determination unit 110 continues to rotate the agitator 75 two more times without stopping after completing an image-forming operation based on a single-page print job (after the agitator 75 has been rotated twice), calculates a new determination value R in the fourth rotation since the rotation was initiated, and determines whether the new determination value R is greater than the determination threshold Th2.

Therefore, the determination unit 110 performs the main determination to determine the replacement timing for the developing cartridge 7 after finding that the determination value R exceeds the provisional determination threshold Th1. When determining that the developing cartridge 7 needs to be replaced, the determination unit 110 notifies the user that it is time to replace the developing cartridge 7.

If the determination unit 110 determines in the main determination that the developing cartridge 7 does not yet need to be replaced, thereafter the determination unit 110 executes the main determination at prescribed intervals (i.e., determines whether the determination value R exceeds the determination threshold Th2).

Specifically, after the determination unit 110 determines that the determination value R exceeds the provisional determination threshold Th1 and sets the provisional determination flag (i.e., when F=1), the determination unit 110 counts the index value indicating the quantity of toner T used when single-page print jobs are inputted consecutively. When this count C exceeds a prescribed value ThC (10, for example), then the determination unit 110 rotates the agitator 75 more than two times continuously and executes the main determination, just as when the determination unit 110 determines whether the determination value R exceeds the provisional determination threshold Th1 in the provisional determination (see FIG. 9B).

After determining in the main determination that the developing cartridge 7 needs to be replaced, the determination unit 110 notifies the user that it is time to replace the developing cartridge 7. However, when the determination unit 110 determines that the developing cartridge 7 does not yet need to be replaced, the determination unit 110 resumes counting the number of consecutively inputted single-page print jobs.

It should also be noted that the determination unit 110 resets the count when the agitator 75 has rotated continuously more than two times and, more specifically, at one of the following timings: when a continuous print job is inputted while counting the number of times single-page print jobs are inputted consecutively and an image-forming operation is executed based on this continuous print job; when rotating the agitator 75 more than two times continuously due to the count C exceeding the prescribed value ThC; and the like. The count is reset in such cases because the main determination is executed. The determination unit 110 also resets the provisional determination flag (i.e., resets F to "0") when the developing cartridge 7 is replaced with a new product.

Figure 10:
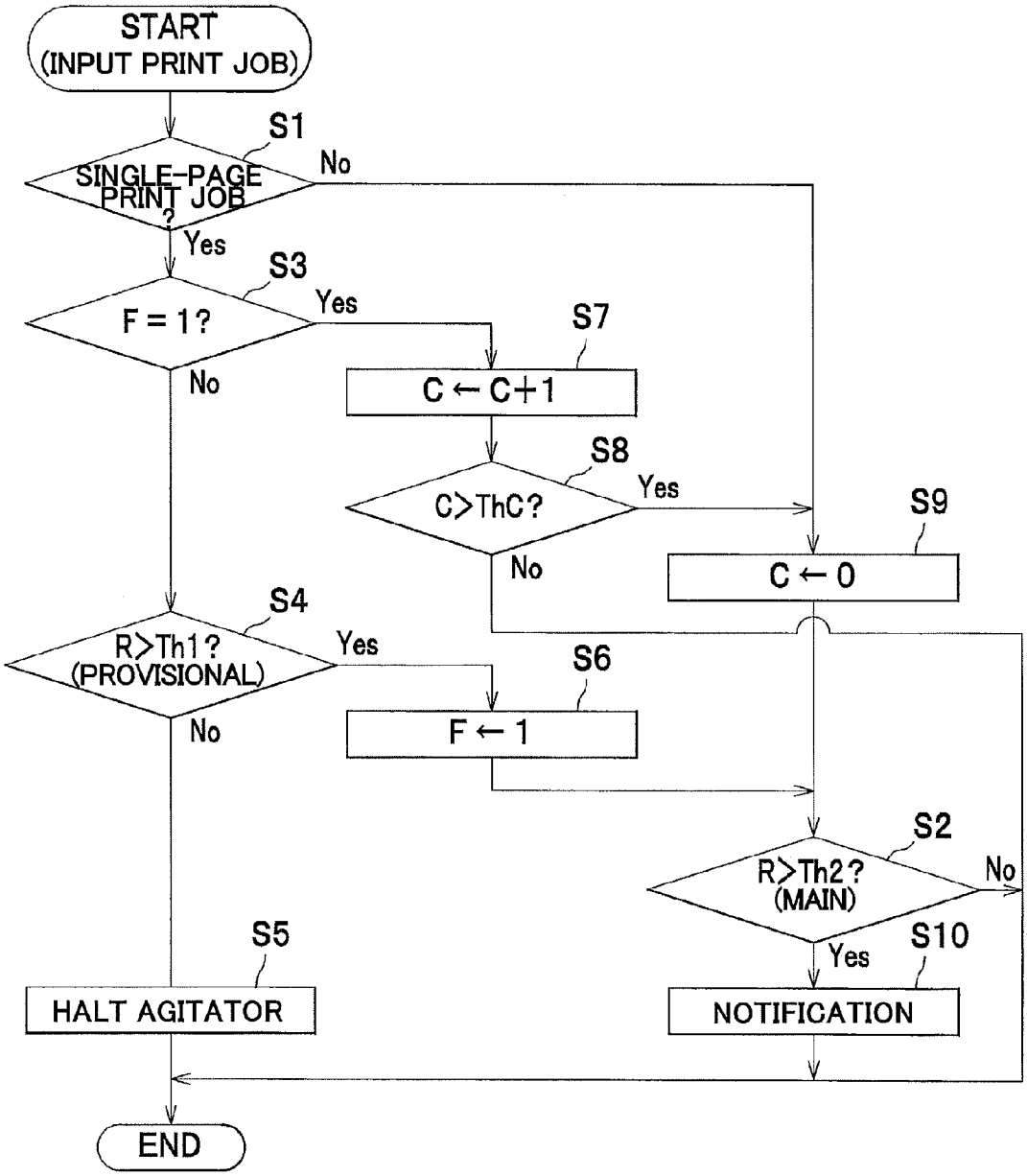
FIG. 10 is a flowchart illustrating steps of control process executed by the image forming device according to the fifth embodiment.

Next, steps in a control process performed on the laser printer 1 according to fifth embodiment will be described with reference to the flowchart in FIG. 10. When a print job is inputted into the laser printer 1 (START), in S1 of FIG. 10 the control unit 100 executes an image-forming operation based on the inputted print job and determines whether the inputted print job is a single-page print job.

If the inputted print job is not a single-page print job (i.e., a continuous print job; S1: NO), in S2 the control unit 100 executes the main determination during the image-forming operation (during the fourth rotation of the agitator 75 in the fifth embodiment). However, if the inputted print job is a single-page print job (S1: YES), then in S3 the control unit 100 determines whether the provisional determination flag has been set (if F=1).

If there is a large amount of toner T in the developing cartridge 7, in the main determination of S2 the determination unit 110 will determine that the determination value R does not exceed the main determination threshold Th2 (S2: NO). Accordingly, the control unit 100 ends the process (END) when the image-forming operation is completed.

Further, when the developing cartridge 7 holds a large amount of toner T and the provisional determination flag has not been set (when F=0; S3: NO), in S4 the control unit 100 executes the provisional determination during the image-forming operation (during the first rotation of the agitator 75). If there is sufficient toner T in the developing cartridge 7, then the determination unit 110 will determine in this provisional determination that the determination value R does not exceed the provisional determination threshold Th1 (S4: NO). Accordingly, in S5 the control unit 100 halts the rotation of the agitator 75 at the completion of the image-forming operation and ends the process (END).

When the quantity of toner T in the developing cartridge 7 decreases to a certain extent, in the provisional determination of S4 the determination unit 110 will determine that the determination value R exceeds the provisional determination threshold Th1 (S4: YES). In this case, in S6 the control unit 100 sets the provisional determination flag (sets F to "1") and in S2, after completion of the image-forming operation, continues to rotate the agitator 75 while executing the main determination. If the control unit 100 determines that the determination value R does not exceed the determination threshold Th2 (S2: NO), the control unit 100 halts the rotation of the agitator 75 and ends the process (END).

When a print job is inputted (START) after the determination unit 110 has determined in the provisional determination that the determination value R exceeds the provisional determination threshold Th1 (when the provisional determination flag has been set), in S1 the control unit 100 executes an image-forming operation based on the inputted print job and determines whether the inputted print job is a single-page print job.

If the inputted print job is a single-page print job (S1: YES), in S3 the control unit 100 determines whether the provisional determination flag has been set (i.e., if F=1). Since the provisional determination flag has been set in this example (S3: YES), in S7 the control unit 100 increments the count C, which indicates the number of consecutively inputted single-page print jobs, and in S8 determines whether the count C exceeds the threshold ThC (10, for example).

If the count C does not exceed the threshold ThC (S8: NO), the control unit 100 ends the process at the completion of the image-forming operation (END). However, if the count C exceeds the threshold ThC (S8: YES), in S9 the control unit 100 resets the count C to "0" and in S2, after completion of the image-forming operation, continues to rotate the agitator 75 while executing the main determination. Upon determining in the main determination that the determination value R does not exceed the determination threshold Th2 (S2: NO), the control unit 100 halts the rotation of the agitator 75 and ends the process (END).

On the other hand, if the determination unit 110 determines in S1 that the inputted print job is a continuous print job (S1: NO), then in S9 the control unit 100 resets the count C to "0" and in S2 executes the main determination during the image-forming operation.

If there is very little toner T remaining in the developing cartridge 7 (when it is time to replace the developing cartridge 7), in S2 the control unit 100 will determine that the determination value R exceeds the main determination threshold Th2 (S2: YES). Accordingly, in S10 the control unit 100 notifies the user that the developing cartridge 7 needs to be replaced and subsequently ends the process (END).

With the configuration described above, the laser printer 1 according to the fifth embodiment obtains the following operational advantages. That is, the determination unit 110 executes the provisional determination first when a single-page print job is received and halts the rotation of the agitator 75 after completion of the image-forming operation when determining in the provisional determination that the determination value R does not exceed the provisional determination threshold Th1. Hence, the laser printer 1 according to the fifth embodiment can reduce the number of times the agitator 75 is rotated more than a printer that determines the replacement timing for a cartridge by rotating the agitator 75 more than two times following every completion of an image-forming operation based on a single-page print job, for example.

By reducing the total rotations of the agitator 75, as well as the developing roller 71 that is configured to rotate together with the agitator 75, the laser printer 1 according to the preferred embodiment can suppress a decline in the charging performance of the toner T, thereby increasing the life of the developing cartridge 7. Since the fifth embodiment can also reduce the initial volume of the toner T accommodated in the developing cartridge 7 while maintaining a lifespan for the developing cartridge 7 generally equal to a conventional developer cartridge, the developing cartridge 7 and the laser printer 1 can be made more compact.

Further, when the determination value R exceeds the provisional predetermined threshold value Th1, the determining unit 110 executes the main determination by first rotating the agitator 75 continuously more than the prescribed number of rotations. Accordingly, the replacement timing can be more accurately determined than when the determination is made in the initial rotation of the agitator 75 (in the first or second rotation).

After determining that the determination value R exceeds the provisional determination threshold Th1 in the fifth embodiment, the determination unit 110 stores this information (sets a provisional determination flag) and executes the main determination at prescribed intervals thereafter (when the number of consecutively inputted single-page print jobs exceeds a prescribed number). Therefore, the laser printer 1 according to the fifth embodiment can further decrease the total number of rotations of the agitator 75 and developing roller 71 more than a printer that executes the main determination after completing each image-forming operation based on a single-page print job when the determination value R was found to exceed the provisional determination threshold Th1.

The prescribed number of rotations in the fifth embodiment is set to the number of times the agitator 75 must rotate until the light reception signal from the light-receiving element has stabilized. Accordingly, by executing the main determination after first rotating the agitator 75 continuously more than the prescribed number of rotations, the replacement timing for the developing cartridge 7 can be accurately determined.

Once the determination unit 110 has determined in the provisional determination that the determination value R exceeds the provisional determination threshold Th1 in the fifth embodiment, the determination unit 110 executes the main determination at prescribed intervals (each time the count C exceeds the threshold value ThC) thereafter, but the present invention is not limited to this configuration. For example, the determination unit 110 may execute the provisional determination each time a single-page print job is received, after the determination value R was found to exceed the provisional determination threshold Th1 one time, and may be configured to execute the main determination only after several instances in which the determination value R was found to exceed the provisional determination threshold Th1 have accumulated, either in total or in succession.

Further, the prescribed interval at which the main determination is executed in the fifth embodiment after the determination value R is found to exceed the provisional determination threshold Th1 is set to the timing at which the number of continuously inputted single-page print jobs exceeds a prescribed number, but the present invention is not limited to this interval. For example, the prescribed interval may be determined as the timing at which the number of dots in an image formed on sheets S after the determination value R was found to exceed the provisional determination threshold Th1 reaches a prescribed number, when means are provided for counting the number of dots. Alternatively, the prescribed interval may be set to the timing at which the number of sheets S that are printed after the determination value R is found to exceed the provisional determination threshold Th1 reaches a prescribed number, when means are provided for counting the number of sheets S. The prescribed interval may also be set to a prescribed elapsed time after the determination value R was found to exceed the provisional determination threshold Th1.

In the fifth embodiment, the determination unit 110 resets the count C if a continuous print job is inputted while counting the number of continuously inputted single-page print jobs, but the determination unit 110 may be configured not to reset the count C in this case.

Next, a sixth embodiment of the present invention will be described. In the fifth embodiment described above, when the determining unit 110 determines that the determination value R exceeds the provisional determination threshold Th1, the control unit 100 first completes the image-forming operation based on the last inputted single-page print job, then continues rotating the agitator 75 without pause to execute the main determination. However, it may be difficult to implement a control process to continue rotating the agitator 75 seamlessly after an image-forming operation is completed due to improved speeds in image-forming operations and the like (i.e., there may be a delay before the control process can be implemented).

Therefore, when the determining unit 110 according to the sixth embodiment determines that the determination value R exceeds the provisional determination threshold Th1, the determining unit 110 waits until the next print job has been inputted before rotating the agitator 75 continuously more than two times in order to execute the main determination.

Figure 11:
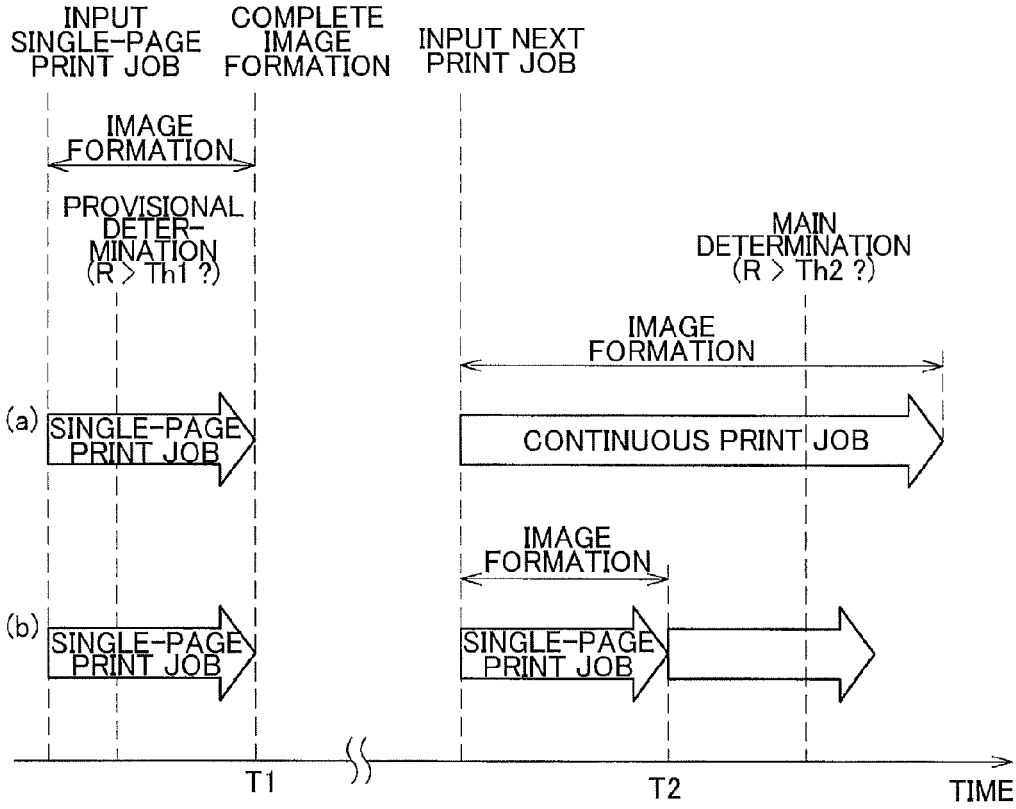
FIG. 11 is an explanatory diagram showing operations executed by an image forming device according to a sixth embodiment after the determination value executed the provisional determination threshold (a) when a continuous print job is received as a next print job and (b) when a single-page print job is received as the next print job.

More specifically, as indicated in (a) and (b) of FIG. 11, when the determining unit 110 determines that the determination value R exceeds the provisional determination threshold Th1 (R>Th1?), the determining unit 110 temporarily halts rotations of the agitator 75 by completing the image-forming operation based on the current single-page print job (timing t1). When the next print job is inputted, the determining unit 110 executes the main determination (R>Th2?).

Note that, if the next inputted print job is a continuous print job as shown in (a) of FIG. 11, the agitator 75 will be continuously rotated more than two times anyway. Therefore, the determining unit 110 executes the main determination during the image-forming operation as usual. When the next inputted job is a single-page print job as shown in (b) of FIG. 11, the determining unit 110 first completes the image-forming operation based on the single-page print job (timing t2), then without pausing continues rotating the agitator 75 for a total of four rotations while making the main determination (see FIG. 9B).

In the sixth embodiment described above, the determination unit 110 executes the main determination after determining that the determination value R is greater than the provisional determination threshold Th1 when the next print job is inputted, but the present invention is not limited to this configuration. For example, the determination unit 110 may execute the main determination only after several print jobs (five print jobs, for example) are inputted following the determination that the determination value R exceeds the provisional determination threshold Th1.

Next, a seventh embodiment of the present invention will be described. When the determining unit 110 according to the seventh embodiment determines that the determination value R has exceeded the provisional determination threshold Th1 in the provisional determination, the determining unit 110 first completes the image-forming operation based on the current single-page print job, then executes the main determination by continuously rotating the agitator 75 a prescribed number of times (four times in this example).

Figure 12:
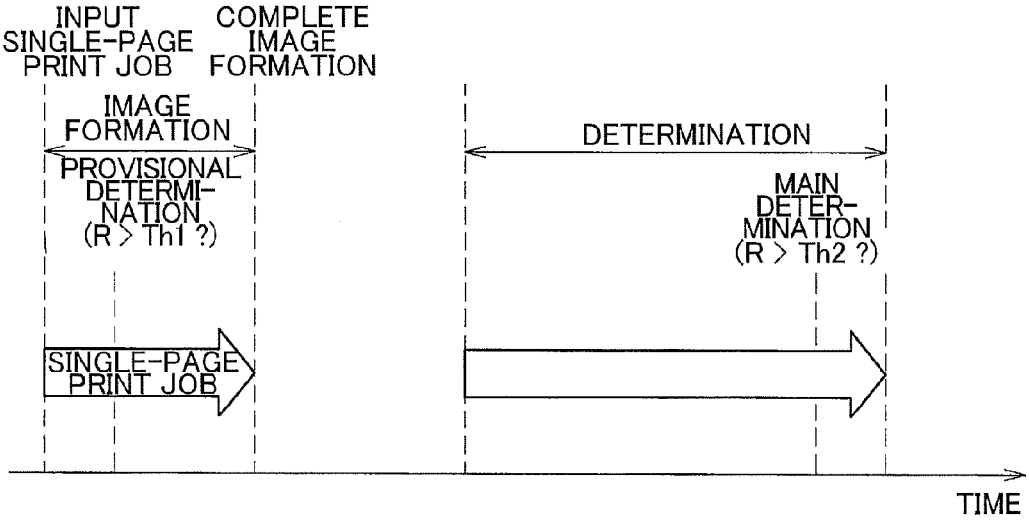
FIG. 12 is an explanatory diagram showing operations executed by an image forming device according to a seventh embodiment.

More specifically, as shown in FIG. 12, when the determining unit 110 determines that the determination value R exceeds the provisional determination threshold Th1 (R>Th1), the determining unit 110 temporarily halts the rotation of the agitator 75 by completing the image-forming operation based on the current single-page print job. Next, with the agitator 75 beginning from an idle state, the determining unit 110 rotates the agitator 75 continuously four times, for example, and executes an operation to make the main determination (R>Th2?) in the fourth rotation.

Note that the determination unit 110 in the seventh embodiment may execute the determination at prescribed intervals (each time a prescribed number of print jobs are inputted, for example) after determining that the determination value R has exceeded the provisional determination threshold Th1. This configuration further reduces the total number of times the agitator 75 and developing roller 71 are rotated.

The present invention according to the sixth and seventh embodiments described above can be applied to a laser printer for accurately determining the replacement timing for the developing cartridge 7 while suppressing a decline in the charging performance of the toner, even in a laser printer performing faster image-forming operations, for example. Put a different way, employing the configurations of the sixth and seventh embodiments can improve the speed of image-forming operations.

Figures 13A, 13B:
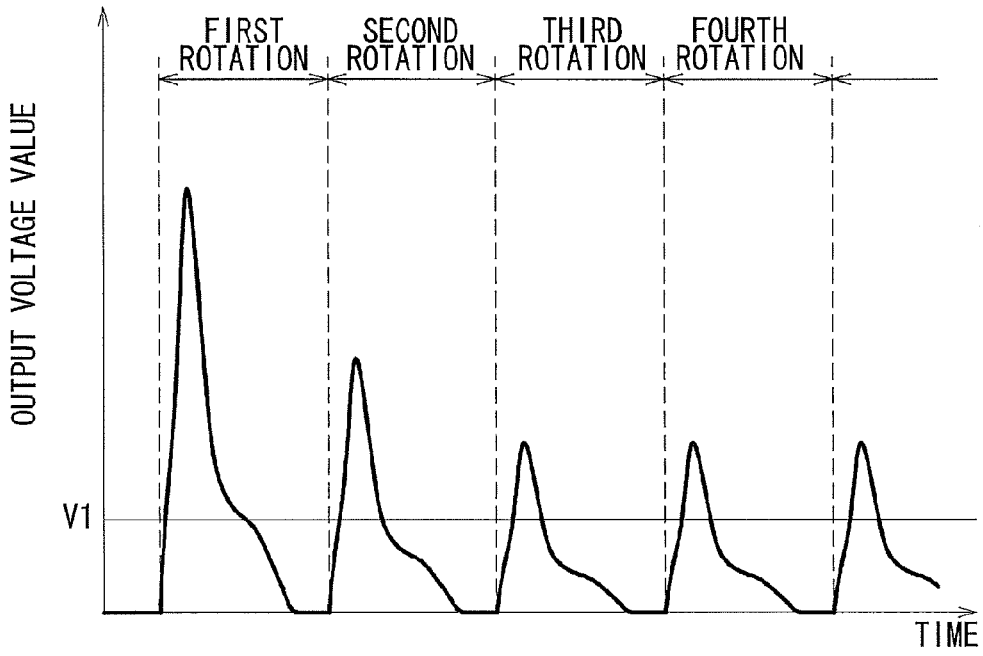
FIG. 13A is a graph indicating a relationship between time and output voltage value of the light-receiving element in an eighth embodiment.
FIG. 13B is an explanatory diagram showing a table storing a plurality of determination thresholds in the eighth embodiment.

Next, an eighth embodiment of the present invention will be described. The determination unit 110 according to the eighth embodiment has a function for determining the replacement timing for the developing cartridge 7 based on the light reception signal outputted from the light-receiving element 92. Specifically, at the beginning of an image-forming operation or the like when the agitator 75 begins rotating, the determination unit 110 first calculates the time during which the output voltage value from the light-receiving element 92 based on the amount of received light exceeds a preset light reception reference value V1 for each rotation (period) of the agitator 75, as shown in the graph of FIG. 13A.

Next, the determination unit 110 calculates the ratio of the time during which this output value exceeds the preset light reception reference value V1 to one period (the time for rotating the agitator 75 one complete rotation) for each rotation (hereinafter referred to as the "determination value"). Next, the determination unit 110 determines whether the calculated determination value exceeds a prescribed ratio (hereinafter referred to as the determination threshold and judges that the developing cartridge 7 needs to be replaced when the determination value exceeds the determination threshold.

For example, if the determination threshold for the third rotation of the agitator 75 is set to 10% and the determination value is 11%, then the determination value exceeds the determination threshold, and the determination unit 110 judges that it is time to replace the developing cartridge 7 currently mounted in the laser printer 1.

As described above, the agitator 75 scatters toner T throughout the developing cartridge 7 by rotating therein. However, toner that has accumulated in the bottom of the developing cartridge 7 cannot be sufficiently scattered during the initial rotation of the agitator 75 (the first and second rotations in FIG. 13A), particularly as the quantity of toner T decreases, as indicated by the solid line in FIG. 2A. Consequently, when the agitator 75 first begins rotating, the irradiated light easily passes through the developing cartridge 7, and the light-receiving element 92 outputs a large voltage.

Hence, if the same determination threshold (10%, for example) were applied to the determination value calculated for each of the first rotation and third rotation, for example, the results for determining the replacement timing for the developing cartridge 7 may be different (may be the opposite).

Therefore, in the eighth embodiment the determination unit 110 uses a different determination threshold according to the rotation number of the agitator 75, from the first rotation through the third rotation. That is, the determination threshold is set to a large value (50%) for the first rotation in which the output values are larger; a smaller value (20%), smaller than that for the first rotation, for the second rotation in which the output values will be smaller than those in the first rotation; and an even smaller value (10%), smaller than that for the second rotation, for the third rotation in which the output values will be smaller than those in the second rotation.

As shown in FIG. 13A, the voltage outputted from the light-receiving element 92 (the waveform of the light reception signal) stabilizes beginning from the third rotation. Accordingly, in the eighth embodiment the same determination threshold (10%) is set for the third and subsequent rotations, as shown in FIG. 13B.

Therefore, the laser printer 1 having the above configuration can accurately determine the replacement timing for the developing cartridge 7, regardless of the rotation number of the agitator 75.

For example, the determination unit 110 performing a determination during the third or later rotation of the agitator 75 may determine that the developing cartridge 7 does not need to be replaced (that the developing cartridge 7 holds sufficient toner T) when applying a determination threshold of 10%. However, the determination unit 110 may calculate a determination value of 40% for the same developing cartridge 7 when performing the determination in the first rotation of the agitator 75. If the determination unit 110 applies the same determination threshold used for the third and subsequent rotations (10%) in this case, then the determination unit 110 will mistakenly determine that the developing cartridge 7 needs to be replaced. However, the determination unit 110 of the eighth embodiment applies a determination threshold of 50% (greater than the determination threshold used in the second and subsequent rotations) when performing the determination in the first rotation having larger output values and, hence, in the above example would not determine that the developing cartridge 7 needs to be replaced. Accordingly, the control unit 100 according to the eighth embodiment can accurately determine the replacement timing for the developing cartridge 7.

As another example, if the determination unit 110 calculates the determination value for the third rotation to be 15%, but applies the determination threshold of 20% used in the eighth embodiment for the second rotation, then the determination unit 110 will determine that the developing cartridge 7 does not need to be replaced, even though the determination unit 110 would determine that the developing cartridge 7 needs to be replaced (has insufficient toner T remaining) if the determination were performed in the first or second rotations. However, the determination unit 110 in the preferred embodiment applies a determination threshold of 10%, which is smaller than the determination threshold used in the first and second rotations, for a determination performed in the third rotation (and subsequent rotations) in which output values are smaller and, hence, would determine correctly in the above example that the developing cartridge 7 needs to be replaced. Accordingly, the laser printer 1 according to the eighth embodiment can more accurately determine the replacement timing for the developing cartridge 7.

By reducing the total rotations of the agitator 75, as well as the developing roller 71 that is configured to rotate together with the agitator 75, the laser printer 1 according to the eighth embodiment can suppress a decline in the charging performance of the toner T.

In the eighth embodiment described above, the determination unit 110 can execute the replacement timing determination without rotating the agitator 75 the number of times (more than two times) required to scatter the toner T uniformly throughout the developing cartridge 7, even when print jobs with few pages are inputted into the laser printer 1. Accordingly, the laser printer 1 according to the eighth embodiment can reduce the total rotations of the agitator 75 and developing roller 71, thereby suppressing a decline in the charging performance of the toner T.

Suppressing a decline in charging performance of the toner T can increase the life of the developing cartridge 7. It is also possible to reduce the initial volume of the toner T accommodated in the developing cartridge 7 while maintaining a lifespan for the developing cartridge 7 generally equivalent to a conventional developer cartridge, thereby making the developing cartridge 7 and the laser printer 1 more compact.

The prescribed number of rotations (three rotations in the eighth embodiment) indicates the number of times the agitator 75 must rotate before the waveform of the light reception signal stabilizes. Therefore, the same determination threshold can be used for the third and subsequent rotations, reducing the number of determination thresholds that must be preset (the volume of data that must be stored).

In the eighth embodiment, the determination value is a ratio of the time during which the output value from the light-receiving element 92 exceeds the light reception reference value V1 (see FIG. 13A), but the present invention is not limited to this definition. A ninth embodiment provides another example of the determination value (and determination threshold).

Figure 14:
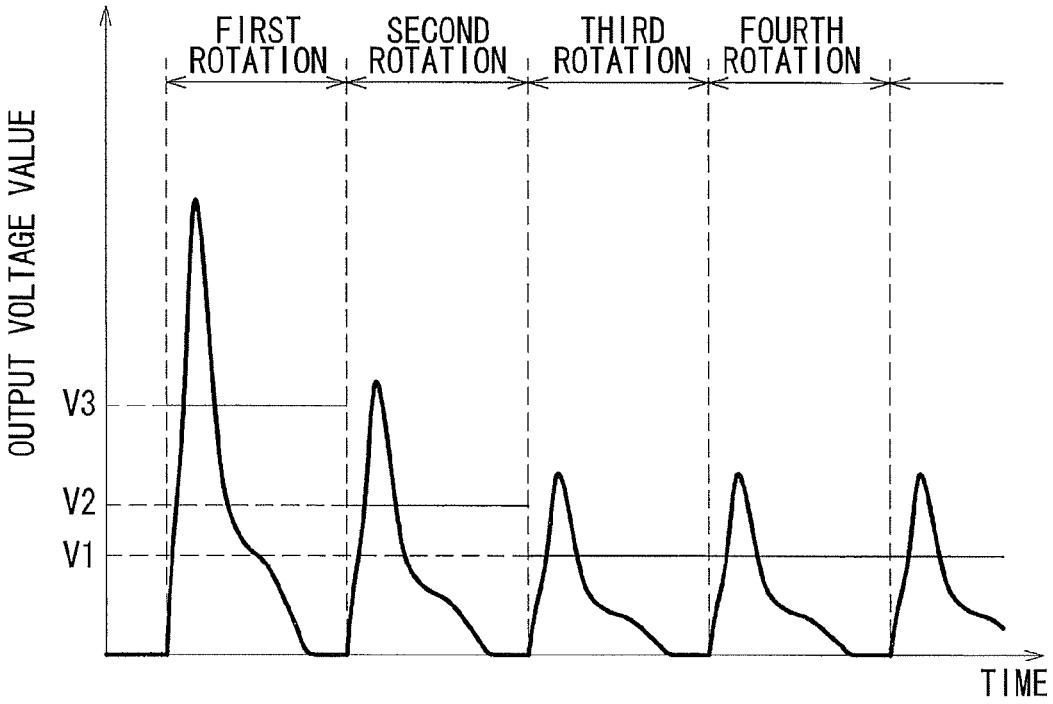
FIG. 14 is a graph indicating a relationship between time and output voltage value of the light-receiving element in a ninth embodiment.

The determination unit 110 according to the ninth embodiment is configured to determine that the developing cartridge 7 needs to be replaced when the output value from the light-receiving element 92 exceeds light reception reference values V1-V3 as shown in FIG. 14. In other words, in the preferred embodiment the determination value is the output value from the light-receiving element 92, while the light reception reference values V1-V3 correspond to the determination threshold.

In the ninth embodiment, the light reception reference value (determination threshold) takes on different values according to the rotation number of the agitator 75, from the first rotation through the third rotation (and subsequent rotations). That is, the light reception reference value is set to a large value V3 for the first rotation during which the output values are larger; a value V2, smaller than the value V3, for the second rotation during which the output values are smaller than during the first rotation; and a value V1, smaller than the value V2, for the third rotation during which the output values are smaller than during the second rotation (V3>V2>V1).

According to the ninth embodiment described above, the determination unit 110 can determine the replacement timing for the developing cartridge 7 with relative accuracy, irrespective of the rotation number of the agitator 75 and can reduce the total rotations of the agitator 75 and developing roller 71, thereby suppressing a decline in the charging performance of the toner T.

Next, a tenth embodiment of the present invention will be described. The determination unit 110 according to the ninth embodiment is configured to determine that it is time to replace the developing cartridge 7 when the output value of the light-receiving element 92 exceeds the light reception reference values V1-V3. In the tenth embodiment, the determination unit 110 is configured to determine the replacement timing according to the same method described in the eighth embodiment, while setting the light reception reference value (a "light reception threshold" in the tenth embodiment) to different values, as in the ninth embodiment described above.

As described in the eighth embodiment, when the output value of the light-receiving element 92 exceeds the light reception thresholds V1-V3 as shown in FIG. 13, the determination unit 110 according to the tenth embodiment calculates the time during which the output values exceed the light reception thresholds V1-V3.

Next, the determination unit 110 calculates the ratio of the time during which the output values exceed the light reception thresholds V1-V3 to the period of the agitator 75 corresponding to the current rotation. For the first rotation, for example, the determination unit 110 calculates the ratio of time during which the output values exceed the first threshold V3 to the current period. For the fourth rotation, the determination unit 110 calculates the ratio of time during which output values exceed the light reception threshold V1 to the current period.

Next, the determination unit 110 determines whether the calculated ratio exceeds a prescribed ratio that has been preset (hereinafter referred to as the "threshold ratio"; a single value used commonly for each rotation in the tenth embodiment) and determines that the developing cartridge 7 should be replaced when the calculated ratio exceeds the threshold ratio. If the threshold ratio is set to 10% irrespective of the rotation number of the agitator 75 and the calculated ratio is 11%, for example, then the calculated ratio exceeds the threshold ratio, and the determination unit 110 determines that the developing cartridge 7 should be replaced.

The determination unit 110 according to the tenth embodiment described above can determine the replacement timing for the developing cartridge 7 with greater accuracy than the determination unit 110 described in the ninth embodiment. Further, as in the eighth and seventh embodiments, the tenth embodiment reduces the total rotations of the agitator 75 and developing roller 71, thereby suppressing a decline in the charging performance of the toner T.

In the tenth embodiment, only the light reception threshold is set to varying values depending on the rotation number of the agitator 75, from the first rotation through the third rotation (and subsequent rotations), but the present invention is not limited to these values. In other words, both the light reception thresholds and threshold ratios may be set to varying values based on the rotation number of the agitator 75, from the first rotation through a prescribed rotation. Incidentally, setting only the second threshold to varying values according to the rotation number of the agitator 75 is identical to the eighth embodiment described above.

While the invention has been described in detail with reference to the embodiments thereof, it would be apparent to those skilled in the art that various changes and modifications may be made therein without departing from the spirit of the invention.

Specific values given for the prescribed number of rotations of the agitator 75, the threshold value for the number of consecutively inputted print jobs, and the like in the first through tenth embodiments are merely examples, and the present invention is not limited to the examples given in the embodiments. For example, the prescribed number of rotations of the agitator 75 is set to the number of times the agitator 75 must rotate before the output value of the light-receiving element is stabilized, and varies according to the capacity of the cartridge (quantity of developer that the cartridge can accommodate), the rotational speed of the agitator 75, and the like.

In the first through tenth embodiments, the determining unit 110 calculates the determination value during the fourth rotation of the agitator 75 after the agitator 75 begins rotating and determines that the developing cartridge 7 needs to be replaced when the determination value exceeds the determination threshold, but the present invention is not limited to this method of determination. For example, the determining unit 110 may calculate the determination value during the third rotation of the agitator 75, or during the third rotation and during each subsequent rotation. Further, the determination value may be calculated as the ratio of time during which the output value from the light-receiving element exceeds the light reception reference value V1 (see FIG. 4A) to a fixed time that includes a plurality of rotating periods. The determining unit 110 may also determine that the developing cartridge 7 needs to be replaced when the output value of the light-receiving element exceeds the light reception reference value V1 (in this case, the light reception reference value V1 corresponds to the determination threshold).

The agitator 75 described in the first through tenth embodiments is merely one example of an agitating member. The agitating member of the present invention may include a plurality of flexible sheet members disposed at intervals in the rotating direction, for example, or may be provided with a light-shielding member disclosed in U.S. Pat. No. 6,337,956.

In the first through tenth embodiments, the light-receiving element 92 outputs a smaller voltage for weaker intensities of received light and a larger voltage for stronger intensities of received light. However, the laser printer may employ a light-receiving element that outputs a larger voltage for weaker intensities of received light and a smaller voltage for stronger intensities of received light, for example.

The developing cartridge 7 according to the first through tenth embodiments has a replaceable configuration that allows it to be mounted in or removed from the main casing 2 while attached to the drum unit 6. However, the cartridge may be configured to be directly mounted in or removed from the main casing instead, for example.

While the developing cartridge 7 is used as an example of the cartridge according to the present invention in the first through tenth embodiments, the present invention is not limited to this cartridge type. For example, the cartridge of the present invention may be a process cartridge integrally (non-detachably) configured of the drum unit 6 and developing cartridge 7 of the preferred embodiments.

The laser printer 1 is given as an example of the image-forming device according to the present invention in the first through tenth embodiments. However, the image-forming device of the present invention may be an LED printer or the like that exposes a photosensitive member with an array of LEDs, for example. Further, the image-forming device is not limited to a printer, but may be a photocopier, multifunction peripheral, or the like provided with an original document reading device, such as a flatbed scanner.

In the fifth through seventh embodiments described above, the determination unit 110 is configured to execute the main determination (i.e., to determine whether the determination value R exceeds the determination threshold Th2 based on the quantity of light received by the light-receiving element 92) after first rotating the agitator 75 continuously more than the prescribed number of times (two times in the preferred embodiments), but the present invention is not limited to this configuration. For example, the determination unit 110 may be configured to execute both the provisional determination and the main determination while the agitator 75 has not yet rotated the prescribed number of times (the first through second rotations in the fifth through seventh embodiments). Put another way, the determination unit 110 may be configured to execute the main determination irrespective of the number of rotations of the agitator 75. With this configuration, the determination unit 110 of the present invention executes the control process described above based on the results of the provisional determination, without notifying the user of the results of the main determination obtained before the agitator 75 has rotated the prescribed number of times.

In the eight through tenth embodiments described above, the same determination threshold is set for third and subsequent rotations, but the present invention is not limited to this configuration. The determination threshold may be set to varying values based on the rotation number for the prescribed rotation and subsequent rotations, for example. This configuration can further enhance the accuracy for determining the replacement timing for the developing cartridge 7 executed during each rotation.

In the eight through tenth embodiments described above, the determination threshold is set to different values for each of the first through third rotations of the agitator 75, but the present invention is not limited to this configuration. For example, the determination threshold may be set to a first determination threshold for the first rotation, a second determination threshold for the second and third rotations, and a third determination threshold for the fourth rotation, where the first through third determination thresholds are all different values. More specifically, the determination threshold of the present invention should at least include a value set for the first rotation of the agitator 75 and a different value set for the prescribed rotation of the agitator 75.

What is claimed is:

1. An image forming device comprising:

a replaceable cartridge accommodating developer therein and including:

an agitator rotatable and configured to agitate developer accommodated in the replaceable cartridge; and a developing roller configured to carry the developer thereon and rotatable together with the agitator;

a light-emitting element configured to emit a light toward the replaceable cartridge; a light-receiving element configured to receive the light emitted by the light-emitting element through the replaceable cartridge to output a signal, a determination value being produced based on the signal;

a determining unit configured to determine whether or not the determination value is greater than a predetermined determination threshold upon the agitator having rotated continuously more than a first prescribed number of times and determine that the replaceable cartridge should be replaced with a new one when the determination value is greater than the predetermined determination threshold;

a counting unit configured to count an index value indicating quantity of developer used while a print job is consecutively inputted a predetermined number of times, an image formation for each of the predetermined number of print jobs being completed before the agitator rotates a second prescribed number of times continuously, the second prescribed number being smaller than or equal to the first prescribed number; and a control unit configured to control the agitator to rotate continuously more than the first prescribed number of times if the index value exceeds a prescribed index threshold.

2. The image forming device according to claim 1, wherein if the index value exceeds the prescribed index threshold, the control unit controls the agitator to continue to rotate when the image formation for a last print job of the predetermined number of print jobs is completed.

3. The image forming device according to claim 1, wherein if the index value exceeds the prescribed index threshold, the control unit controls the agitator to halt rotating when the image formation for a last print job of the predetermined number of print jobs is completed and further controls the agitator to begin to rotate when a subsequent print job is received, wherein determination by the determining unit is implemented upon the agitator having rotated continuously more than the first prescribed number of times since the agitator begins to rotate for the image formation of the subsequent print job.

4. The image forming device according to claim 1, wherein if the index value exceeds the prescribed index threshold, the control unit controls the agitator to halt rotating when the image formation for a last print job of the predetermined number of print jobs is completed and further controls the agitator to begin to rotate when a predetermined duration of time is elapsed since the agitator halts rotating.

5. The image forming device according to claim 1, wherein the counting unit resets the index value each time the agitator rotates continuously more than the first prescribed number of times.

6. The image forming device according to claim 1, wherein the index value is a dot number of images that have been formed based on the print jobs on recording sheets.

7. The image forming device according to claim 1, wherein the index value is a sheet number of recording sheets that have been printed based on the print jobs.

8. The image forming device according to claim 1, wherein the index value is a job number of the print jobs that have been inputted consecutively.

9. The image forming device according to claim 1, wherein determination by the determining unit is implemented at prescribed intervals, the prescribed interval being a duration longer than a duration required to continuously rotate the agitator the first prescribed number of times.

10. An image forming device comprising:

a replaceable cartridge accommodating developer therein and including:

an agitator rotatable and configured to agitate developer accommodated in the replaceable cartridge; and a developing roller configured to carry the developer thereon and rotatable together with the agitator;

a light-emitting element configured to emit a light toward the replaceable cartridge; a light-receiving element configured to receive the light emitted by the light-emitting element through the replaceable cartridge to output a signal, a determination value being produced based on the signal;

a determining unit configured to determine whether or not the determination value is greater than a predetermined determination threshold upon the agitator having rotated continuously more than a first prescribed number of times and determine that the replaceable cartridge should be replaced with a new one when the determination value is greater than the predetermined determination threshold;

a provisional determining unit configured to determine, upon consecutively receiving a print job a predetermined number of times, whether or not the determination value is greater than a provisional predetermined determination threshold before the agitator has been rotated a second prescribed number of times, an image formation for each of the predetermined number of print jobs being completed before the agitator rotates the second prescribed number of times continuously, the second prescribed number being smaller than or equal to the first prescribed number, the provisional predetermined determination threshold being different from the predetermined determination threshold;

a control unit configured to control the agitator to halt rotating after the image formations for the predetermined number of print jobs are completed if the provisional determining unit determines that the determination value is smaller than or equal to the provisional predetermined determination threshold and control the agitator to continue to rotate if the provisional determining unit determines that the determination value is greater than the provisional predetermined determination threshold;

wherein the determining unit determines whether or not the determination value is greater than the predetermined determination threshold upon the agitator having rotated continuously more than the first prescribed number of times if the provisional determining unit determines that the determination value is greater than the provisional predetermined determination threshold, and determines that the replaceable cartridge should be replaced with a new one when the determination value is greater than the predetermined determination threshold.

11. The image forming device according to claim 10, wherein if the provisional determining unit determines that the determination value is greater than the provisional predetermined determination threshold, the control unit controls the agitator to continue to rotate when the image formations for the predetermined number of print jobs are completed.

12. The image forming device according to claim 10, wherein if the provisional determining unit determines that the determination value is greater than the provisional predetermined threshold, the control unit controls the agitator to halt rotating when the image formation for a last print job of the predetermined number of print jobs is completed and further controls the agitator to begin to rotate when a subsequent print job is received, wherein determination by the determining unit is implemented upon the agitator having rotated continuously more than the first prescribed number of times since the agitator begins to rotate for the image formation of the subsequent print job.

13. The image forming device according to claim 10, wherein if the provisional determining unit determines that the determination value is greater than the provisional predetermined threshold, the control unit controls the agitator to halt rotating when the image formation for a last print job of the predetermined number of print jobs is completed and further controls the agitator to begin to rotate when a predetermined duration of time is elapsed since the agitator halts rotating.

14. The image forming device according to claim 10, wherein determination by the determining unit is implemented after the provisional determining unit determines that the determination value is greater than the provisional predetermined threshold at prescribed intervals.

15. The image forming device according to claim 10, wherein the signal is stably outputted from the light receiving elements when the agitator rotates the first prescribed number of times.

16. An image forming device comprising:

a replaceable cartridge accommodating developer therein and including:

an agitator rotatable and configured to agitate developer accommodated in the replaceable cartridge; and a developing roller configured to carry the developer thereon and rotatable together with the agitator;

a light-emitting element configured to emit a light toward the replaceable cartridge;

a light-receiving element configured to receive the light emitted by the light-emitting element through the replaceable cartridge to output a signal, a determination value being produced based on the signal each time when the agitator rotates one time;

a determining unit configured to:

determine whether or not the determination value is greater than a first predetermined threshold when the agitator has made first one rotation and determine that the replaceable cartridge should be replaced with a new one when the determination value is greater than the first predetermined threshold;

determine whether or not the determination value is greater than a second predetermined threshold when the agitator has rotated a prescribed number of times and determine that the replaceable cartridge should be replaced with a new one when the determination value is greater than the second predetermined threshold.

17. The image forming device according to claim 16, wherein the second predetermined threshold is different from the first predetermined threshold.

18. The image forming device according to claim 16, wherein the light-receiving element continuously outputs the signal with updated determination value; wherein the image forming device further comprises a calculating unit configured to calculate a ratio of a duration during which the output value exceeds a light reception reference value in one rotation to a duration during which the agitator rotates one time.

19. The image forming device according to claim 16, wherein the determination value is an output value acquired from the signal outputted by the light-receiving element.

20. The image forming device according to claim 16, wherein the light-receiving element continuously outputs the signal with updated determination value;

wherein the image forming device further comprises a calculating unit configured to:

calculate, when the agitator has made first one rotation, a first ratio of a duration during which the output value exceeds a first light reception reference value in the first one rotation of the agitator to a duration during which the agitator rotates one time, as the determination value; and calculate, when the agitator has rotated the prescribed number of times, a second ratio of a duration during which the output value exceeds a second light reception reference value in the prescribed number of times of rotation of the agitator to the duration during which the agitator rotates one time, as the determination value;

wherein the determining unit determines whether or not the first ratio is greater than the first predetermined threshold when the agitator has made the first one rotation, and determine that the replaceable cartridge should be replaced if the first ratio is greater than the first predetermined threshold;

wherein the determining unit determines whether or not the second ratio is greater than the second predetermined threshold when the agitator has rotated the prescribed number of times and determines that the replaceable cartridge should be replaced with a new one when the second ratio is greater than the second predetermined threshold;

wherein at least one of the following conditions (a) the second light reception reference value is different from the first light reception reference value; and (b) the second predetermined threshold is different from the first predetermined threshold is satisfied.

21. The image forming device according to claim 16, wherein the determination value is updated each time the agitator rotates one time since the agitator has made the first one rotation until the agitator has rotated the prescribed number of times, each of the prescribed number of predetermined determination thresholds being preset for respective ones of the prescribed number of rotations, the plurality of predetermined determination thresholds including the first predetermined threshold and the second predetermined threshold, the plurality of predetermined values being different from one another;

wherein the determining unit determines, each time the determination value is updated, the determination value is greater than each of the predetermined determination thresholds, and determines that the replaceable cartridge should be replaced if the first ratio is greater than the predetermined determination threshold.

22. The image forming device according to claim 16, wherein the signal is stably outputted from the light receiving elements when the agitator rotates the prescribed number of times.

* * * * *